US006340924B1

(12) United States Patent
Shimizu et al.

(10) Patent No.: US 6,340,924 B1
(45) Date of Patent: Jan. 22, 2002

(54) REPEATEDLY USABLE HIGH-OPERATING-SPEED CIRCUIT PROTECTION DEVICE USING REED MEMBERS

(75) Inventors: Nobuyoshi Shimizu; Koichi Kondoh; Chiaki Maeno, all of Tokyo (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/616,967

(22) Filed: Jul. 14, 2000

(30) Foreign Application Priority Data

Sep. 28, 1999 (JP) ..... 11-274753
Apr. 27, 2000 (JP) ..... 12-132900

(51) Int. Cl.[7] ..... H01H 1/66; H01H 51/00
(52) U.S. Cl. ..... 335/151; 335/152; 335/154
(58) Field of Search ..... 335/15, 16, 151–154, 335/205–208, 273

(56) References Cited

U.S. PATENT DOCUMENTS 3,742,404 A * 6/1973 Hamilton, Jr. ..... 335/153
4,126,841 A * 11/1978 Maeno ..... 335/154
4,399,421 A * 8/1983 MacLean ..... 335/174

FOREIGN PATENT DOCUMENTS

JP 54-22806 8/1979

OTHER PUBLICATIONS

Hara, Toshito et al., "Strange Behaviors in High Current Dry Reed Switch", Fujitsu Laboratories LTD., 20th Holm Seminar on Electric Contact Phenomena, Chicago, Oct. 29–31, 1974, pp. 179–184.

* cited by examiner

*Primary Examiner*—Ramon M. Barrera
(74) *Attorney, Agent, or Firm*—Staas & Halsey LLP

(57) ABSTRACT

The present invention provides a circuit protection device that comprises at least one set of reed members having a pair of reed members, wherein each of the reed members is constituted by a magnetic material and disposed in such a way as to be opposed to the other of the reed members and has an end disposed in such a manner as to be apart by a predetermined gap from and contactable with an end of the other of said reed members, magnetic-field generating unit placed in vicinity of the reed members set and adapted to generate a holding magnetic field for maintaining a state, in which the end of the reed members are in contact with each other, after the ends of the reed members are attracted to each other and the contacts are closed and a contact gap reduction unit for reducing the gap to a gap corresponding to a pull-in of the magnetic field generated by said magnetic-field generating unit.

18 Claims, 17 Drawing Sheets

REPEATEDLY USABLE HIGH-OPERATING-SPEED CIRCUIT PROTECTION DEVICE USING REED MEMBERS

BACKGROUND OF THE INVENTION

1. Field of the Invention

The present invention generally relates to a circuit protection device for interrupting overcurrents that occur due to surges, sparks, or the like.

2. Description of the Related Art

In recent years, various kinds of information services including the Internet have rapidly come into wide use. The construction of information communication networks has been greatly expedited, so that many devices, such as telephone sets, modem devices, and network devices, are complicatedly connected to one another through communication lines and commercial power lines. Thus, accidents may occur as follows. For example, a failure of the communication device can be caused by an overcurrent resulting from a lightning surge, which passes from the communication line to the power line or vice versa. Further, another failure of the communication device can be caused by a spark generated when a certain wire, which is cut for some reason, is brought into contact with an adjacent wire.

A fusible member (namely, a fuse), a mechanical switch, an electronic switch, or the like is used as a circuit protection device for opening a circuit when an overcurrent flows through a communication device. Generally, for instance, a circuit protection device employing a relay as a mechanical switch further has a circuit for detecting a current flowing through the communication line or the power line at all times, and a circuit for opening the relay when detecting an overcurrent.

A circuit protection device employing a fusible member requires replacement of the fusible member with a new one each time an interrupting operation is performed.

Further, a circuit protection device employing a mechanical switch, such as a relay switch, is large in size and weight, and unsuitable for protecting a very small and light circuit. Moreover, this circuit protection device employing a mechanical switch is slow in response, and cannot sufficiently protect the circuit.

Furthermore, a circuit protection device employing an electronic switch is complex in configuration.

Accordingly, in view of above-mentioned problem, an object of the present invention is to provide a repeatedly usable circuit protection device which is small in size, light weight, high in operating speed and simple in structure.

SUMMARY OF THE INVENTION

To achieve the foregoing object, according to the present invention, there is provided a circuit protection device that comprises at least one set of reed members having a pair of reed members, wherein each of the reed members is constituted of a magnetic material and disposed in such a way as to be opposed to the other of the reed members and has an end disposed in such a manner as to be apart by a predetermined gap from and contactable with an end of the other of said reed members, a magnetic-field generating unit placed in vicinity of the reed members set and adapted to generate a holding magnetic field, for maintaining a state in which the end of the reed members are in contact with each other, after the ends of the reed members are attracted to each other, and the contacts are closed, and a contact gap reduction unit for reducing the gap to a gap corresponding to a pull-in of the magnetic field generated by said magnetic-field generating unit.

The present invention provides such a circuit protection device for protecting a circuit against an overcurrent, which has a simple structure and is small in size and weight. The operating speed of this circuit protection device is high. Moreover, this circuit protection device is easily reset even after an interrupting operation is once performed on the circuit so as to interrupt overcurrent conditions. Thus, this circuit protection device can withstand repetitive use.

BRIEF DESCRIPTION OF THE DRAWINGS

Other features, objects and advantages of the present invention will become apparent from the following description of preferred embodiments with reference to the drawings in which like reference characters designate like or corresponding parts throughout several views and in which.

DETAILED DESCRIPTION OF THE PREFERRED EMBODIMENTS

First, the operating principle utilized in a circuit protection device of the present invention will be described hereunder with reference to FIGS. 1 to 4.

Figure 1:
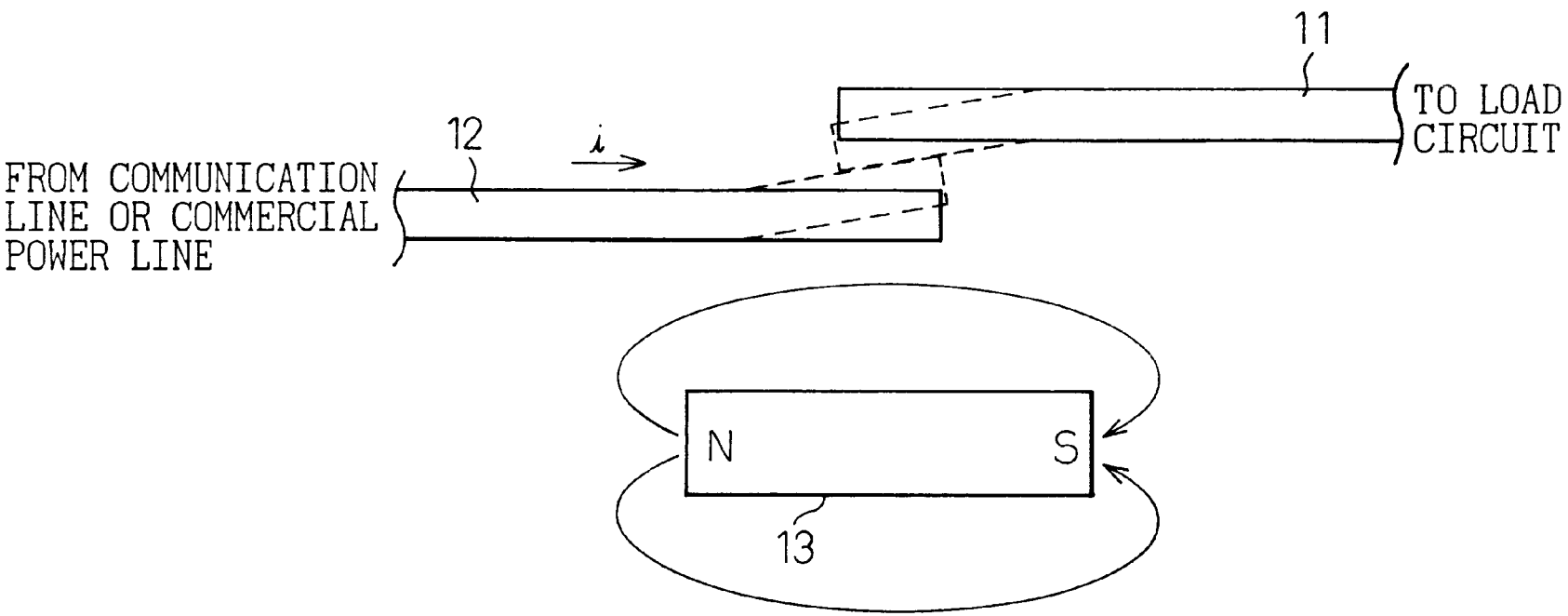
FIG. 1 is a diagram illustrating the principle of a circuit protection device utilizing the operating principle of a reed switch.

FIG. 1 is a diagram illustrating the principle of a circuit protection device utilizing the operating principle of a reed switch.

As illustrated in FIG. 1, the first reed member 11 and the second reed member 12 partly overlap with each other and are configured in such a manner as to be opposed to each other and provide a contact gap therebetween. Further, a magnetic-field generating unit 13 is disposed in the proximity of these reed members 11 and 12. If an overcurrent i owing to various kinds of surges or sparks flows from the second reed member 12 to the first reed member 11, that is, in the direction of the arrow in this figure, magnetic poles of the magnetic-field generating unit 13 are configured in such a manner as to be N-S along the second reed member 12 and the first reed member 11, in order. Namely, the magnetic-field generating unit 13 is configured in such a way that the direction of a component of magnetic lines of flux generated by the magnetic-field generating unit 13, which is parallel to these reed members 11 and 12, matches the direction of the overcurrent i flowing through these reed members 11 and 12 which are in contact with each other. Either the first reed member 11 or the second reed member 12 is connected to a load circuit to be protected, and the other reed member is connected to communication lines or commercial power lines. In the case of FIG. 1, the first reed member 11 is connected to the load circuit, and the second reed member 12 is connected to communication lines or commercial power lines. The state in which the first reed member 11 and the second reed member 12 are attracted to each other is maintained by a holding magnetic field that is generated by the magnetic-field generating unit 13, as indicated by dash line in this figure. Thus, an electric current conducting path i.e., a main current conducting path is formed for a circuit current flowing through the load circuit via the reed members 11 and 12. When the overcurrent i owing to various kinds of surges or sparks flows through the load circuit in the direction of the arrow in this figure, the first reed member 11 and the second reed member 12 open, so that the load circuit is interrupted.

Figure 2:
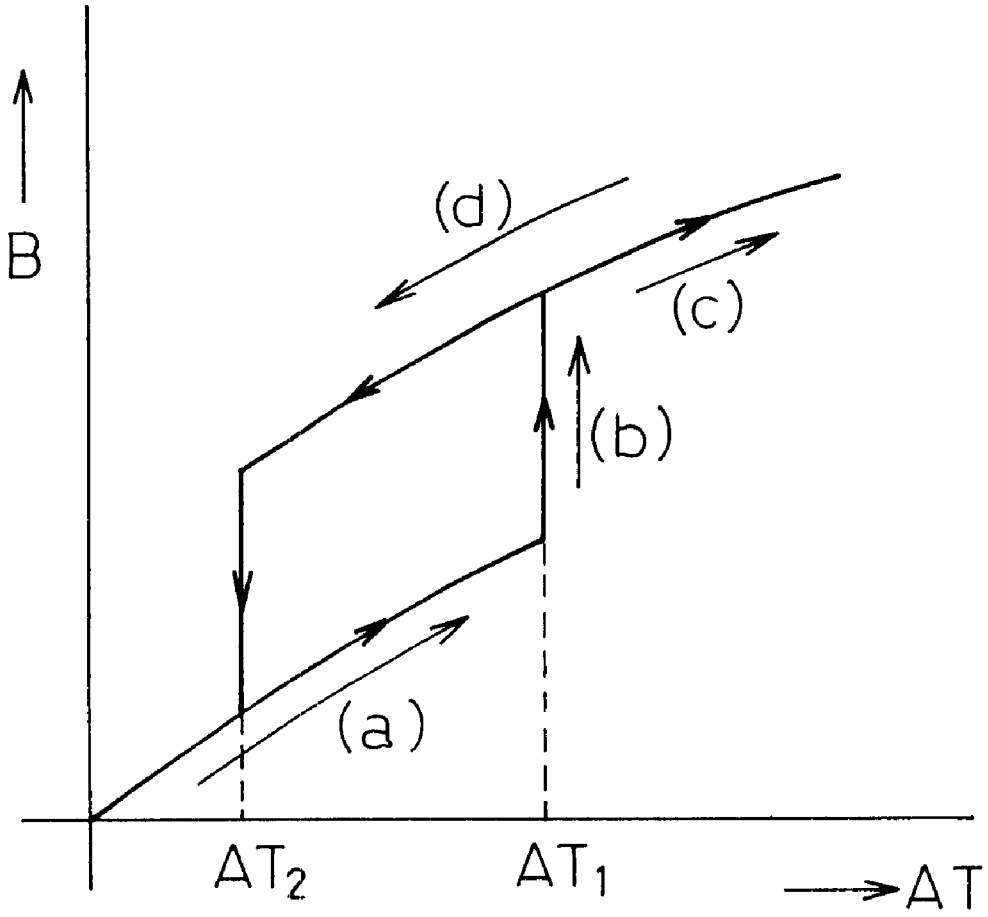
FIG. 2 is a graph illustrating an operation of a reed member when no circuit current flows.

FIG. 2 is a graph illustrating an operation of a reed member when no circuit current flows. In this figure, reference characters AT and B respectively denote the magnitude of a magnetomotive force of a magnetic field generated by the magnetic-field generating unit 13, and a magnetic flux penetrating each of the first reed member 11 and the second reed member 12.

First, if the magnitude of the magnetomotive force AT increases, the magnetic flux increases, as represented by a line (a). When the magnitude of the magnetomotive force AT reaches a value $AT_1$, the first reed member 11 and the second reed member 12 are attracted to each other, so that the contacts are closed. The magnitude $AT_1$ of the magnetomotive force at that time is referred to as a "pull-in". The gap between the first reed member 11 and the second reed member 12 becomes 0 at that time. Thus, the magnetic reluctance or resistance decreases. Consequently, as indicated by a line (b), the magnetic flux sharply increases by a predetermined value. As the magnitude AT of the magnetomotive force is increased still more, the magnetic flux increases, as indicated by a line (c). Conversely, as the magnitude AT of the magnetomotive force is reduced, the magnetic flux B decreases, as indicated by a line (d). However, even when the magnitude of the magnetomotive force AT is not more than the value $AT_1$, the contacts are not opened. When the magnitude of the magnetomotive force AT is reduced still more and reaches a value $AT_2$, the contacts are opened. The value $AT_2$ of the magnetomotive force at that time is referred to as a "drop-out". That is, the characteristics of the opening and closing operations of the reed members show hysteresis.

Figure 3:
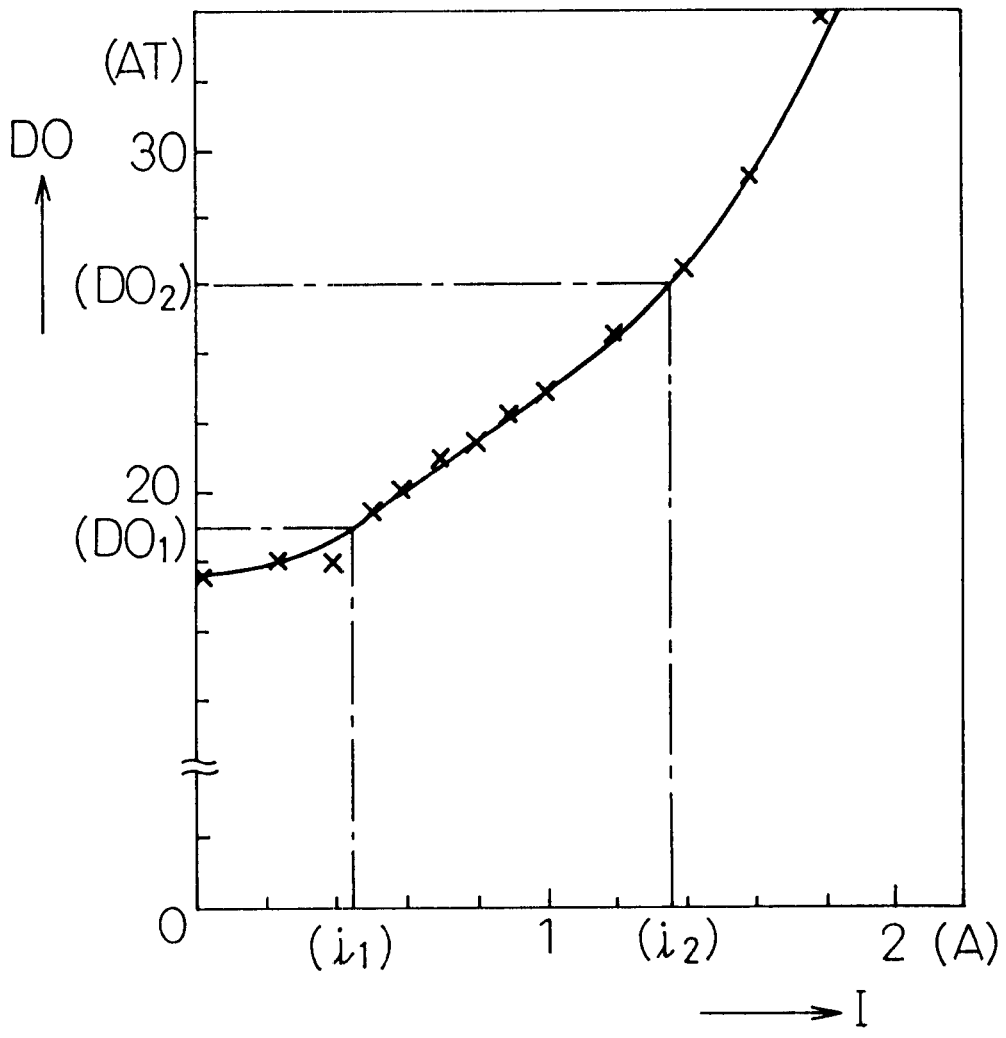
FIG. 3 is a graph illustrating the relation between a circuit current I, which flows through the reed member, and a drop-out DO of a generated magnetic field.

FIG. 3 is a graph illustrating the relation between the circuit current I, which flows through the reed member, and the drop-out DO of a generated magnetic field. In this graph, the axis of the abscissa indicates the circuit current I, while the axis of the ordinate indicates a value DO, at which the contacts are opened, of the magnitude of the magnetomotive force. Incidentally, note that the value $AT_2$ described in FIG. 2 represents a value obtained in the case that the circuit current I flows through the circuit, while the drop-out DO described in FIG. 3 is a value obtained in the case that the circuit current I flows therethrough.

When the circuit current I increases from $i_1$ to $i_2$, the drop-out increases from $DO_1$ to $DO_2$. This is because the holding magnetic field is weakened by the magnetic field and heat generated by the circuit current I. It is, therefore, necessary to increase the magnitude of the holding magnetic field, by which the contacts are attracted to each other, when the circuit current is large.

Incidentally, this principle is disclosed in Japanese Examined Patent publication (Kokoku) No. 54-22806 as the operating principle of a circuit protection device using a reed switch.

The circuit protection devices of the present invention utilize the aforementioned feature. That is, before being set, in the circuit protection circuit in which the first reed member 11 and the second reed member 12 are opened, the contact gap between the reed members 11 and 12 is reduced to a contact gap corresponding to a pull-in $AT_1$ of the magnetomotive force due to the magnetic field generated by the magnetic-field generating unit 13. Thus, the first reed member 11 and the second reed member 12 are attracted to each other, and the contacts are closed. Either the first reed member 11 or the second reed member 12 is connected to a load circuit to be protected, and the other reed member is connected to communication lines or commercial power lines. If a holding magnetic field, whose magnetomotive force is not more than AT, and lies between drop-outs $DO_1$ and $DO_2$, is set when the circuit current I flows through the load circuit, the reed members 11 and 12 are attracted to each other when the circuit current I is in a steady state and has a value $i_1$. However, when the circuit current I reaches a value $i_2$ (corresponding to an overcurrent), the holding magnetic field is weakened by a magnetic field and heat generated by the circuit current I, so that the first reed member 11 and the second reed member 12 are opened, and the load circuit is interrupted.

Figure 4:
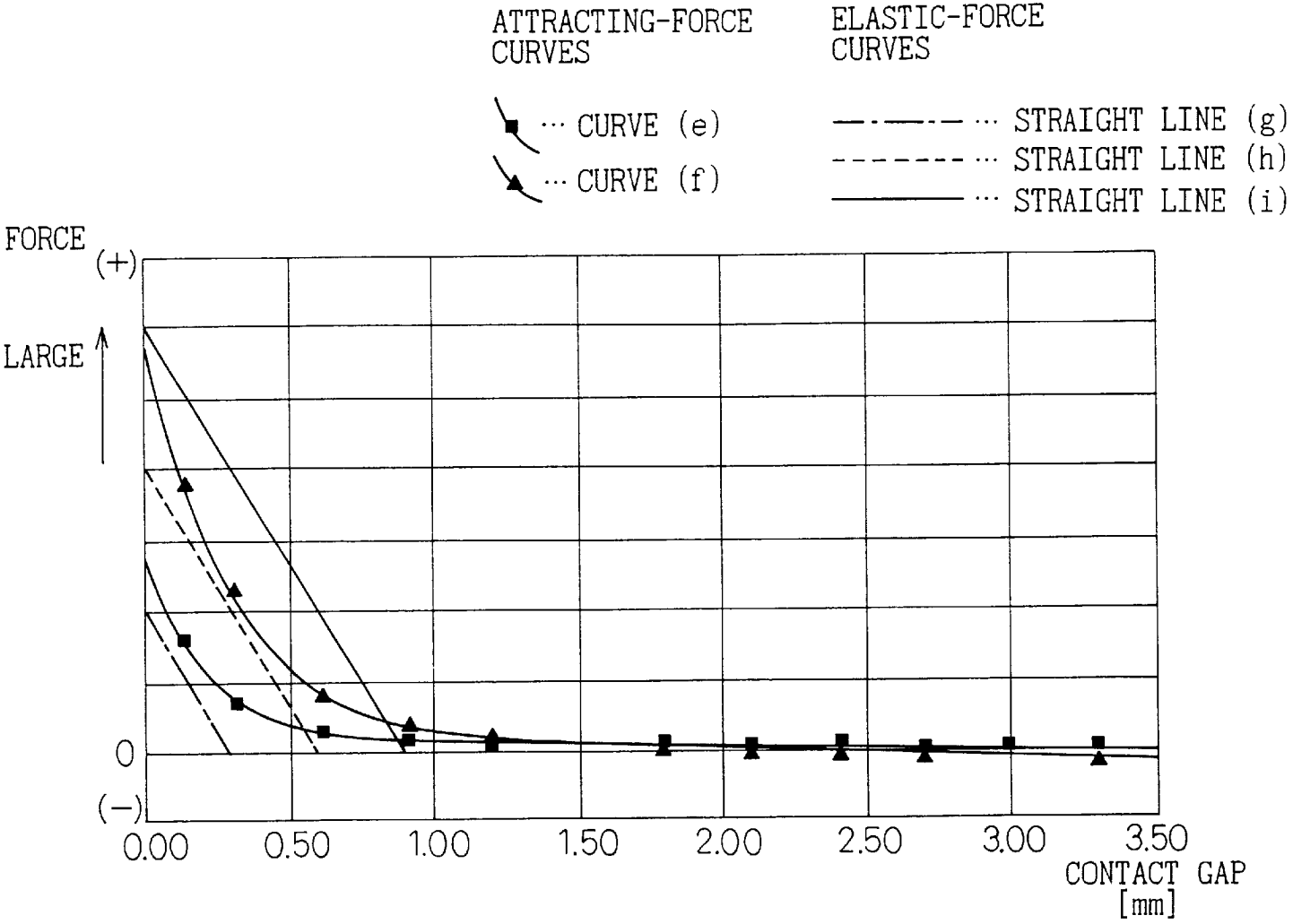
FIG. 4 is a graph illustrating the relation between the contact gap and attracting force of the reed member.

FIG. 4 is a graph illustrating the relation between the contact gap and attracting force of the reed member. In this graph, the axis of the abscissa indicates the contact gap d between the reed members, while the axis of the ordinate indicates the magnitude of the attracting force, generated owing to the holding magnetic field, on the reed member and the magnitude of the elastic force of the reed member.

Curves (e) and (f) indicate the characteristics of the attracting force between the reed members and respectively correspond to the case in which the magnetomotive force is small and to the case in which the magnetomotive force is large. Hereunder, these curves will be referred to as "attracting-force curves".

Straight lines (g), (h), and (i) indicate the elastic characteristics of each of the reed members and respectively correspond to the elastic forces arranged in the ascending order of the magnitudes thereof. Hereinafter, these lines will be referred to as "elastic-force curves".

When the magnitude of the attracting force, which is caused by the holding magnetic field and acts between the first reed member 11 and the second reed member 12, is larger than that of the elastic force of each of these reed members, the first reed member 11 and the second reed member 12 are attracted to each other. For example, when the contact gap is 0.50 mm, the attracting force is larger than the elastic force, if the first reed member 11, the second reed member 12, and the magnetic-field generating unit 13 are selected so that the corresponding attracting-force curve and the corresponding elastic-force curve are the curve (f) and the line (h), respectively. Thus, the first reed member 11 and the second reed member 12 are attracted to each other.

That is, the circuit protection device having the operating principle described with reference to FIGS. 1 to 3 is realized by selecting the first reed member 11, the second reed member 12, and the magnetic-field generating unit 13 at a given contact gap, based on the comparison between the attracting-force curve, which is determined by the attracting force acting between the reed members 11 and 12, and the elastic-force curve, which is determined by the elastic force of each of these reed members, in such a manner that the attracting force is larger than the elastic force.

It is known (see IEC60950, "Safty of Information Technology Equipment") that, when performing an interrupting operation and opening the contacts, a contact gap of 2.0 mm is necessary in the case of using a 4 kv line, and a contact gap of 4.0 mm is necessary in the case of using a 7 kv line so as to enable the circuit protection device to sufficiently perform the function of interrupting very large overcurrent caused owing to a lightning surge voltage. Further, the circuit needs a contact gap of, for instance, 1.0 mm in such a way as to be able to withstand sparks caused at breakdown failures occurring in the case of using a 6 kv line. However, as illustrated in FIG. 4, if the contact gap is, for instance, 2.0 mm, no matter what material is selected as the material of the reed members, the attracting force generated owing to the holding magnetic field cannot maintain the state in which the reed members are attracted to each other.

Therefore, in the case of the circuit protection device of the present invention, the reed members are pushed by external mechanical forces until the contact gap between the reed members reaches a value at which the reed members are attracted to each other, for the following reason. That is, even if the contact gap is too large, so that the state in which the reed members are attracted to each other cannot be maintained, such a state can be maintained depending upon the selection of the first reed member 11, the second reed member 12, and the magnetic-field generating unit 13, by reducing the contact gap to a value at which the elastic force of each of the reed members is larger than the attracting force acting between the reed members.

A circuit protection device according to the present invention comprises at least one set of reed members having a pair of reed members, wherein each of the reed members is constituted by a magnetic material and disposed in such a way as to be opposed to the other of the reed members and has an end disposed in such a manner as to be apart by a predetermined gap from and contactable with an end of the other of said reed members, a magnetic-field generating unit placed in vicinity of the reed members set and adapted to generate a holding magnetic field for maintaining a state in which the end of the reed members are in contact with each other, after the ends of the reed members are attracted and contacted to each other, and a contact gap reduction unit for reducing the gap to a gap corresponding to a pull-in of the magnetic field generated by said magnetic-field generating unit.

In the case of the circuit protection device using the reed members, according to the present invention, an interrupting operation is achieved so as to protect the circuit against overcurrents, generated owing to surges and sparks, which cannot be coped with by the prior art.

In the foregoing description, the operating principle utilized by a circuit protection device of the present invention has been described with reference to FIGS. 1 to 4. Hereinafter, circuit protection devices, which are first and second embodiments of the present invention, will be described in detail.

Figure 5:
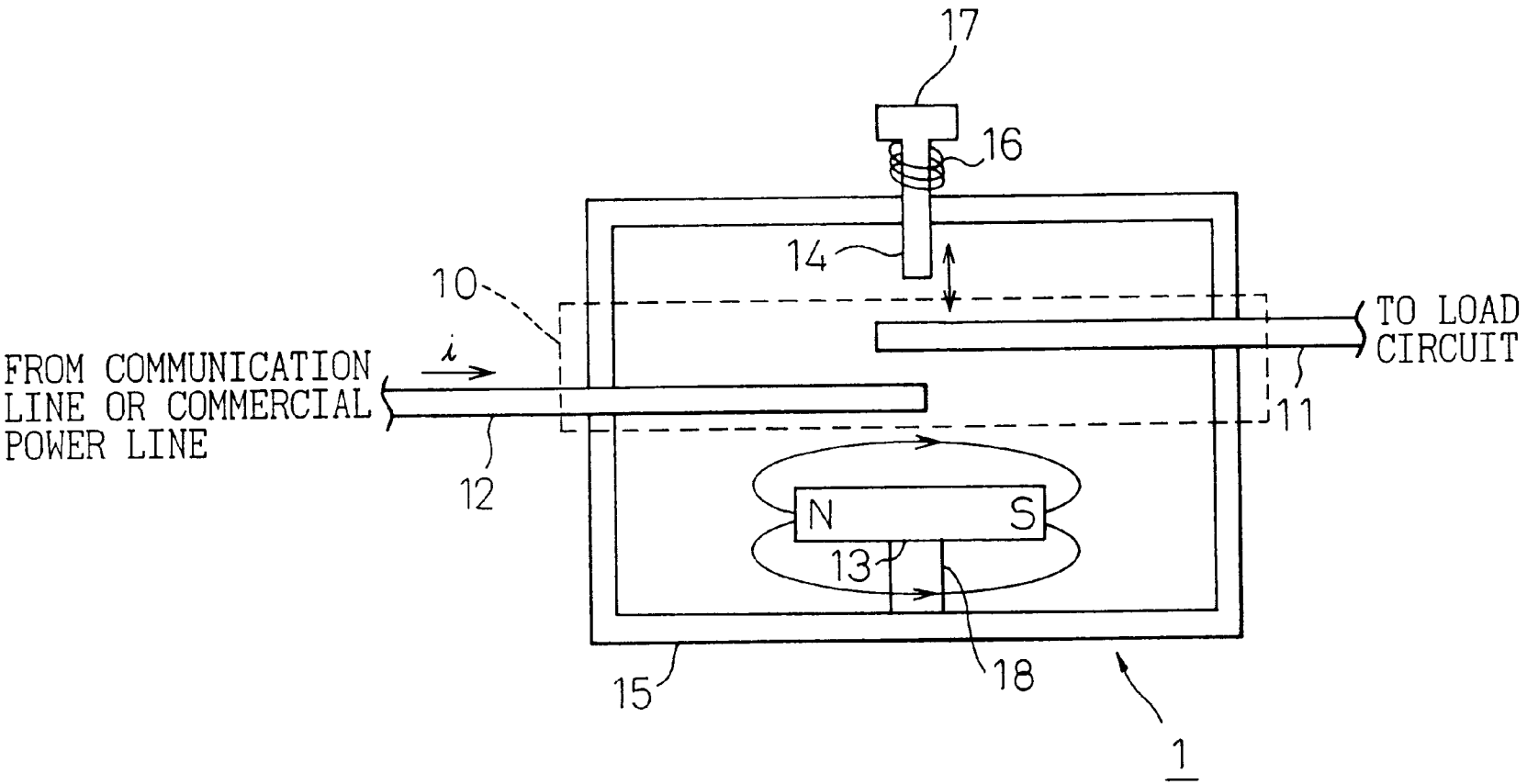
FIG. 5 is a top view of a circuit protection device according to a first embodiment of the present invention.
Figure 6:
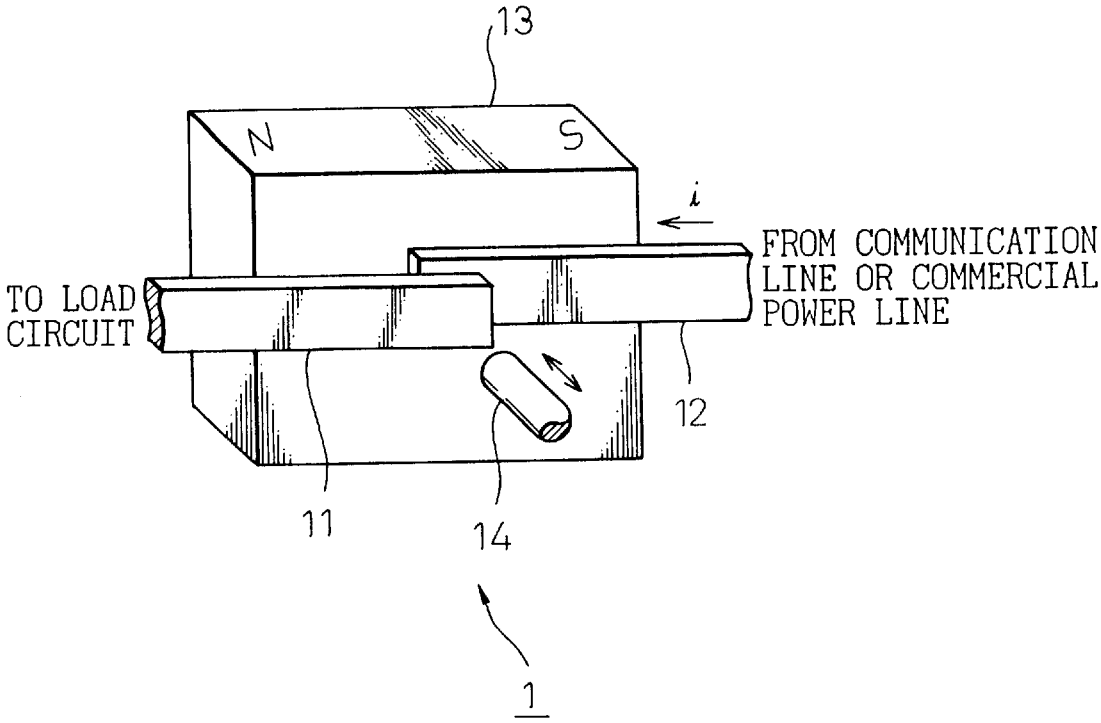
FIG. 6 is a perspective view of a circuit protection device according to the first embodiment of the present invention.

FIG. 5 is a diagram illustrating a circuit protection device that is the first embodiment of the present invention. FIG. 6 is a perspective view of a circuit protection device according to the first embodiment of the present invention.

A circuit protection device 1 according to the embodiment has a first reed member 11 and a second reed member 12, each of which is constituted by a magnetic material and disposed in such a way as to be opposed to the other of the reed members and has an end disposed in such a manner as to be separated by a predetermined distance from and contactable with an end of the other of the reed members, a magnetic-field generating unit 13 placed in the vicinity of the first reed member 11 and the second reed member 12 and adapted to generate a holding magnetic field for maintaining a state in which the ends of the first and second reed members are in contact with each other, after the ends of the first and second reed members are attracted and contacted to each other, and a contact gap reduction unit 14 for reducing the gap between the ends of the first and second reed members to a gap corresponding to a pull-in of the magnetic field generated by magnetic-field generating unit 13. Either the first reed member 11 or the second reed member 12 is connected to the load circuit to be protected, and the other reed member is connected to communication lines or commercial power lines. Overcurrent i owing to various kinds of surges or sparks is assumed to flow in the direction of the arrow in this figure.

As shown in FIGS. 5 and 6, in view of the fact that the first reed member 11 and the second reed member 12 are brought into contact with each other, these reed members are opposed in such a manner as to have overlapping portions. Moreover, in this embodiment, the contact gap between the overlapping portions of the first reed member 11 and the second reed member 12 is set at 2.00 mm by taking into consideration an interrupting operation against a surge. The value of the contact gap is not limited to this. The contact gap may be set at other values.

The other end of each of the first reed member 11 and the second reed member 12 of the reed member set is fixed to a housing 15, as shown in FIG. 5. This embodiment uses a resin molding as the material of the housing 15. Alternatively, the circuit protection device may employ a double-molded structure realized by embedding the reed members 11 and 12 in resin.

A permanent magnet 13 is disposed on the housing 15, via a support 18, in the vicinity of the gap provided on the first reed member 11 and the second reed member 12 as illustrated in FIGS. 5 and 6. Namely, the magnetic-field generating unit 13 is configured in such a way that the direction of a component of magnetic lines of flux generated by the magnetic-field generating unit 13, which is parallel to these reed members 11 and 12, matches the direction of the overcurrent i flowing through these reed members 11 and 12 which are in contact with each other. Incidentally, an electromagnet, or a combination of a permanent magnet and an electromagnet may be used as the magnetic-field generating unit.

A contact gap reduction unit 14 is made of a non-magnetic material, and is disposed in the proximity of the contacts respectively provided on the first reed member 11 and the second reed member 12. The contact gap reduction unit 14 of this embodiment is usually positioned away from the first reed member 11 by a certain distance. A spring 16 is provided between a button 17 of the contact gap reduction unit 14 and the outer wall portion of the housing 15. The contact gap reduction unit 14 is moved upwardly and downwardly in the direction of the first reed member 11 by depressing the button 17 or canceling the depression of the button 17. Incidentally, for simplicity of description, the housing 15, the spring 16, the button 17 and the spring 18 are omitted in FIG. 6.

When the button 17 is depressed, the contact gap reduction unit 14 is moved in the direction of the first reed member 11, and brought into contact with the first reed member 11. After the contact gap reduction unit 14 touches the first reed member 11, this reed member 11 is pushed toward the second reed member 12. As a result of using the contact gap reduction unit 14 in this way, the contact gap between the first reed member 11 and the second reed member 12 is decreased by a mechanical force. It is sufficient to reduce the contact gap at least to a certain distance, at which the first reed member 11 and the second reed member 12 are attracted to each other by a force caused by the holding magnetic field. A stopper or the like may be additionally provided so as to let a user know the contact gap at that time. When canceling the depression of the button 17, the contact gap reduction unit 14 is returned to the initial position by the elastic force of the spring 16.

As long as the contact gap between the first reed member 11 and the second reed member 12 can be decreased, the structure of the aforementioned contact gap reduction unit 14 is not limited to the herein-above-described structure. The contact gap reduction unit 14 may have, for example, a structure in which the contact gap is decreased by using a plunger and depressing a button part provided thereon, alternatively, it may have a structure in which the contact gap is reduced by driving the plunger by the use of a motor.

Figure 7:
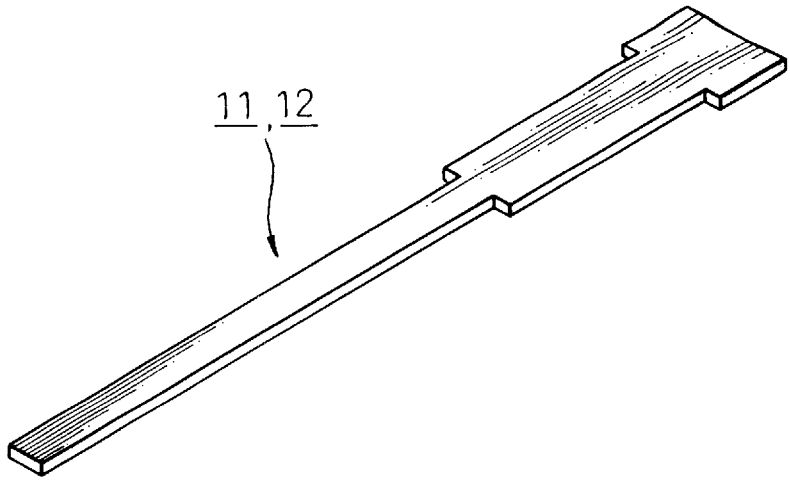
FIG. 7 is a diagram illustrating an example of the reed member according to the present invention.

FIG. 7 is a diagram illustrating an example of the reed member according to the present invention. The shapes of the reed members are not limited to this shape. The reed members may have other shapes.

The first reed member 11 and the second reed member 12 are made of magnetic materials. In the case of this embodiment, a 50—50 alloy of iron and nickel (namely, containing 50% nickel) is employed as the magnetic material. The resistivity and stiffness of this alloy are 40 $\mu\Omega$cm, and 13.6 g/mm, respectively. These reed members are formed by cutting and pressing 0.32-mm-thick bars and by then performing magnetic annealing thereof at about 850° C. to thereby eliminate distortion due to the press working. The resistance of the reed member is 0.02 Ω. Contacts are provided on the surfaces, which are to be in contact with each other, of the first reed member 11 and the second reed member 12. These contacts are formed by plating, cladding (or bonding), welding, caulking or the like.

A plurality of the circuit protection device according to this embodiment above-mentioned may be connected in series each other so as to protect the load circuit.

Next, an operation flow of the circuit protection device, which is the first embodiment of the present invention, will be described herein below.

Figure 8:
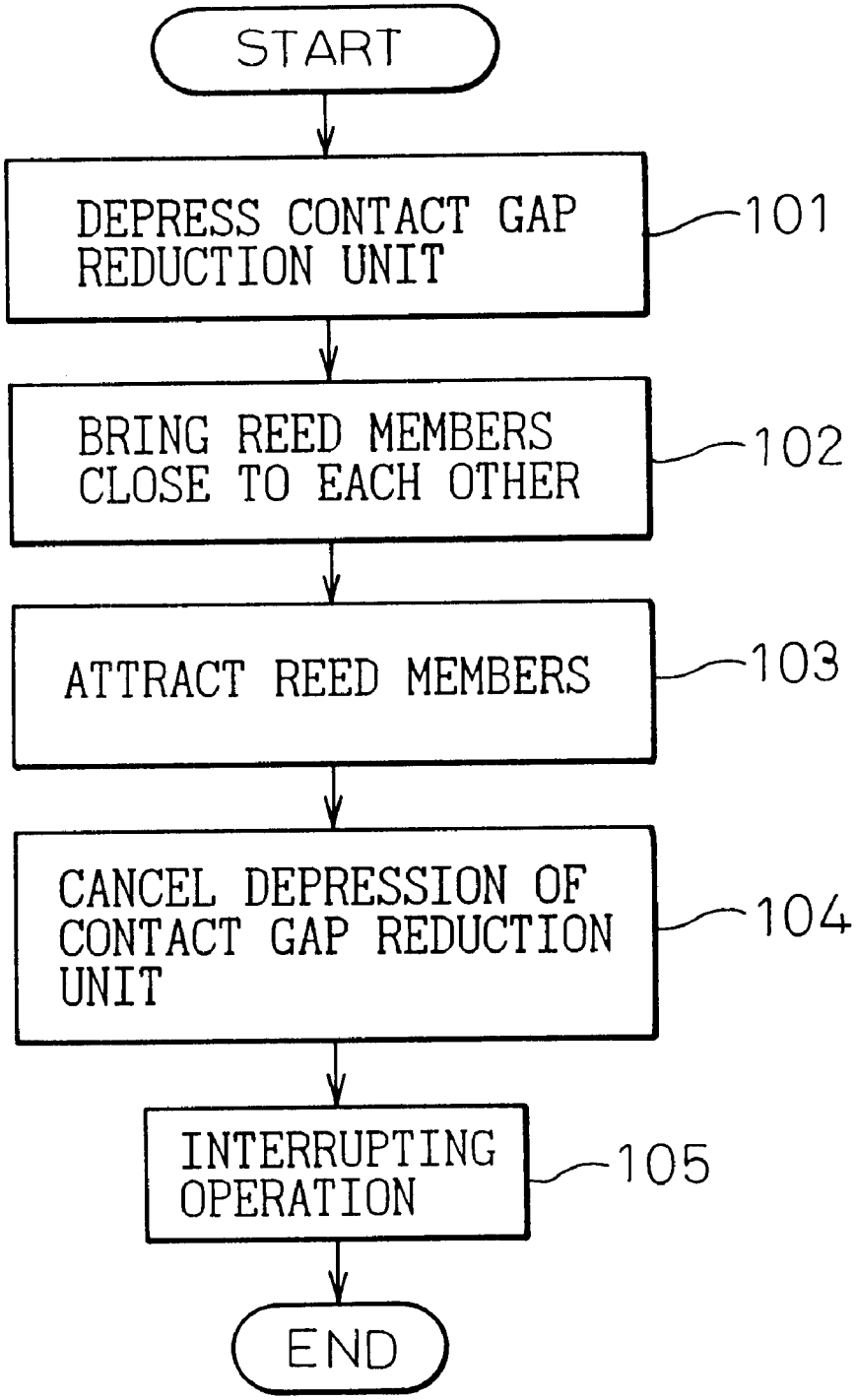
FIG. 8 is a flowchart illustrating an operation of the circuit protection device according to the first embodiment of the present invention.

FIG. 8 is a flowchart illustrating an operation flow of the circuit protection device that is the first embodiment of the present invention. In the case that either the first reed member 11 or the second reed member 12 is connected to the load circuit to be protected and the other reed member is connected to communication lines or commercial power lines, a sequence of steps from a setting operation of the circuit protection device of this embodiment to an interrupting operation thereof when an overcurrent occurs due to a surge or sparks will be described hereinbelow.

First, the button 17 of the contact gap reduction unit 14 is depressed at step 101 so as to set the circuit protection device of this embodiment. Then, at step 102, the contact gap reduction unit 14 moves in the direction of the first reed member 11 and is brought into contact therewith. Thereafter, the first reed member 11 is pushed toward the second reed member 12. Thus, the first reed member 11 gradually approaches the second reed member 12. When the first reed member 11 approaches the second reed member 12 and the contact gap becomes a value at which a state wherein the reed members 11 and 12 are attracted to each other is maintained, the reed members start to be attracted to each other and are thus attracted thereto (step 103). Subsequently, if the depression of t button 17 is canceled at step 104, the contact gap reduction unit 14 is returned to an initial position by an elastic force of the spring 16. Thus, the state in which the reed members are attracted to each other, is maintained. The setting of the circuit protection device is performed at steps 101 to 104 and then completed. Thereafter, when an overcurrent i with a large energy due to a surge or a spark flows through the circuit, the holding magnetic field for maintaining such a state, in which the reed members are attracted to each other, is weakened and is not more than the drop-out amount, the first reed member 11 and the second reed member 12 open. Thus, the load circuit is interrupted (step 105).

As above described, according to this embodiment, even in the case of the circuit protection device employing the reed members, a sufficient contact gap for interrupting overcurrent conditions due to various kinds of surges or sparks is ensured. Thus, a circuit protection device, which has a simple structure and is small in size and weight, is realized. Moreover, when an overcurrent flows through the circuit, the reed members automatically open. Therefore, the response speed is high. Even after an interrupting operation is once performed so as to protect the circuit from the overcurrent, the circuit protection device is easily reset by only operating the contact gap reduction unit. Consequently, the circuit protection device of the present invention can withstand repetitive use.

Next, another circuit protection device, which is a second embodiment of the present invention, will be described hereunder.

As described above, the circuit protection device of the present invention is adapted so that when the magnitude of the circuit current flowing through the load circuit to be protected is not less than a predetermined value, the contacts of the reed members open, even though these contacts have been maintained, till then, in a state in which the contacts are in contact with each other. As described with reference to FIGS. 1 to 3, the larger the magnitude of the circuit current in a stationary state, the larger the magnitude of the holding magnetic field, for maintaining a state in which the contacts of the reed members are in contact with each other, must be.

A lightning surge due to lightning may enter the communication device not only through a communication line but also through a power line. Usually, the magnitude of a signal current flowing through the communication device is small and, for instance, 20 mA or so. However, a large current flows through the power line even in a stationary state. Thus, when a circuit protection device is provided for the power line, there is the necessity for taking the step of increasing the magnitude of the holding magnetic field.

In the case of the second embodiment of the present invention, the circuit protection device can be applied to the case of allowing a larger circuit current to flow through the circuit. This circuit protection device, which is the second embodiment, is realized by providing an additional current shunting path in the first embodiment of the present invention illustrated in FIG. 5.

Figure 9:
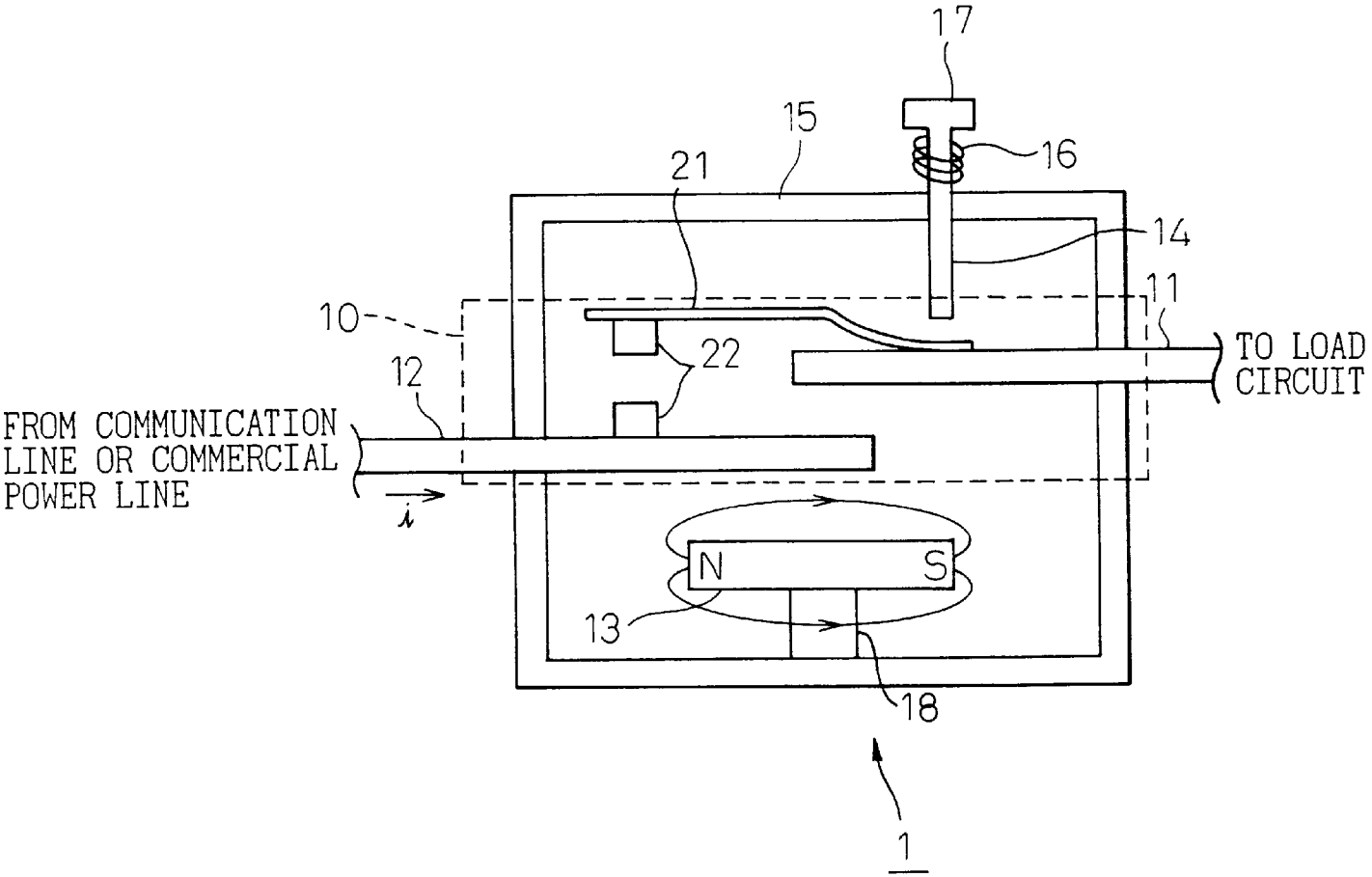
FIG. 9 is a top view of a circuit protection device according to a second embodiment of the present invention.
Figure 10:
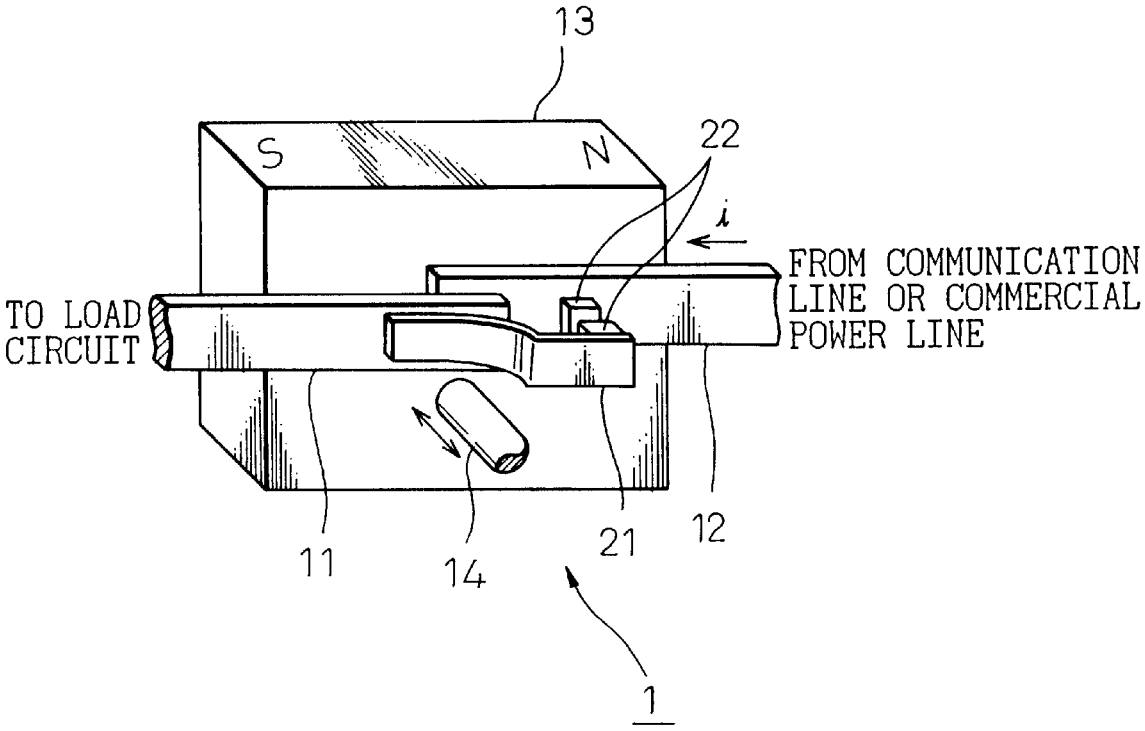
FIG. 10 is a perspective view of a circuit protection device according to the second embodiment of the present invention.

FIG. 9 is a top view of a circuit protection device according to a second embodiment of the present invention. FIG. 10 is a perspective view of a circuit protection device according to the second embodiment of the present invention.

The second embodiment further comprises a current shunting path 21, which has one end connected to the first reed member 11 and also has the other end adapted to be brought into contact with the second reed member 12 via an additional contact 22 when the first reed member 11 and the second reed member 12 are in contact with each other, and to be released from the second reed member 12 when the first reed member 11 and the second reed member 12 are released from each other. Either the first reed member 11 or the second reed member 12 is connected to a load circuit to be protected, and the other reed member is connected to communication lines or commercial power lines. The overcurrent i owing to various kinds of surges or sparks, flows in the direction of the arrow in this figure.

Incidentally, for simplicity of description, the housing 15, the spring 16, the button 17 and the support 18 are omitted in FIG. 10. Moreover, the constituent elements, functions, operations, features, and alternatives other than the current shunting path are similar to the corresponding ones of the first embodiment and are thus omitted herein.

Incidentally, for simplicity of description, the drawing of a contact gap reduction unit, which is provided in the second embodiment, and is similar to that in the first embodiment, is omitted in this figure. Moreover, the constituent elements, functions, operations, features, and alternatives other than the current shunting (conductive) path are similar to the corresponding ones of the first embodiment and are thus omitted herein.

As shown in FIGS. 9 and 10, the second embodiment has a movable spring 21 and a contact 22 as the current shunting path. The movable spring 21 has an end connected to the first reed member 11, and also has a contact provided at the other end thereof. This contact 22 is formed by plating, cladding, welding, caulking or the like.

The movable spring 21 is made of an elastic material. When the first reed member 11 and the second reed member 12 are in contact with each other, the movable spring 21 is in contact with the second reed member 12 through the contact 22. When the first reed member 11 and the second reed member 12 open, the contact 22 provided on the spring 21 is released from the second reed member 12.

It is preferable, for permitting this circuit protection device 1 to cope with a large current, that a larger amount of electric current flows through the current shunting path consisting of the first reed member 11 and the second reed member 12, as compared with an amount of electric current flowing through a main current path consisting of the first reed member 11 and the second reed member 12. Therefore, preferably, the movable spring 21 is made of a material having a resistivity lower than the resistivity of the material of the first reed member 11 and the second reed member 12. Thus, in the second embodiment, the movable spring 21 is made of a copper alloy. However, the material of the movable spring 21 is not limited thereto. Other materials may be employed for the movable spring 21, as long as such materials meet the aforementioned conditions.

Incidentally, such a movable spring may be further provided on the second reed member 12.

Thus, according to the second embodiment of the present invention, the circuit protection device can cope with the case in which a large circuit current flows through the circuit, by being provided with an additional current shunting path. Thus, for example, in a communication device, the circuit protection device of this embodiment can be used not only for a signal line but also for a power line.

Figure 11:
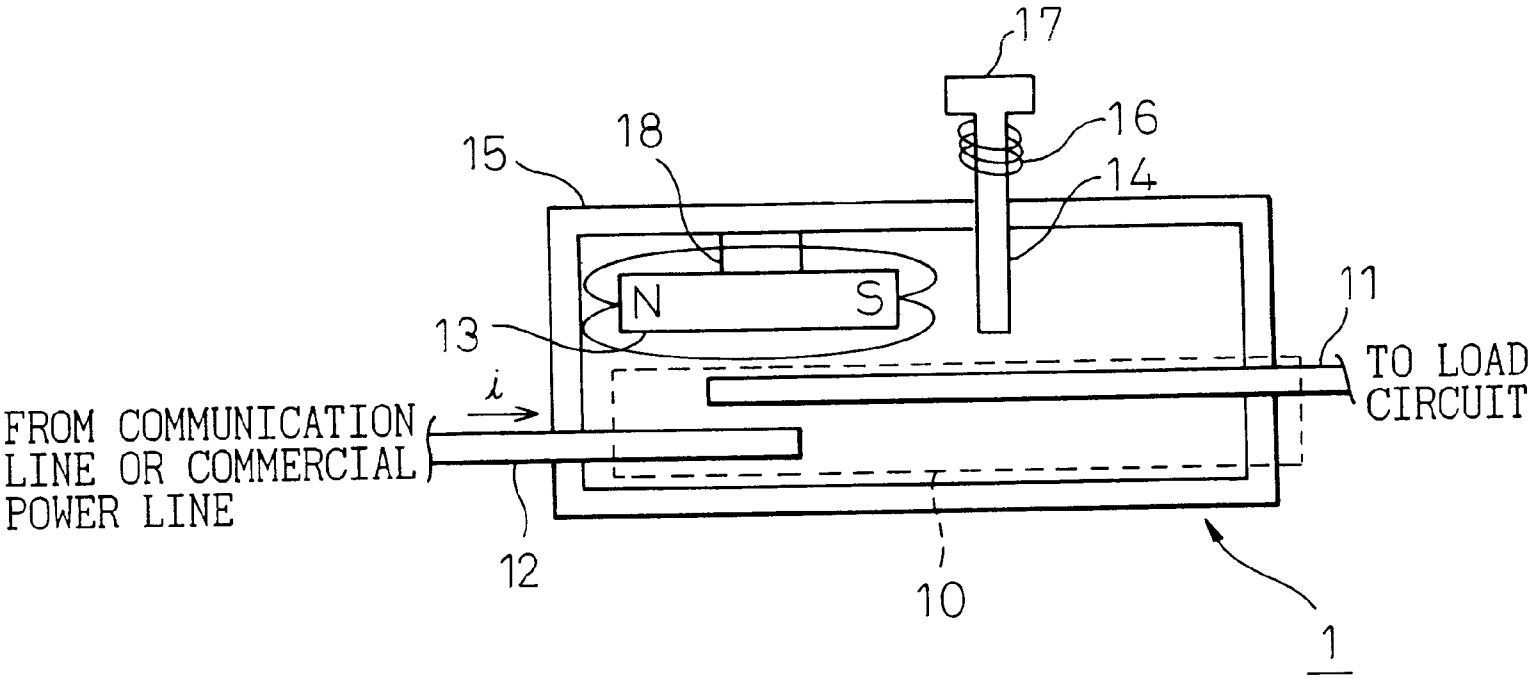
FIG. 11 is a top view of a circuit protection device according to a third embodiment of the present invention.

In the case of a third embodiment of the present invention, the circuit protection device is further miniaturized. FIG. 11 is a top view of a circuit protection device according to a third embodiment of the present invention. Incidentally, the constituent elements, functions, operations, features, and alternatives other than an arrangement of a permanent magnet 13 and contact gap reduction unit 14 are similar to the corresponding ones of the first and second embodiments and thus omitted herein.

In the circuit protection device 1 according to the first and second embodiments of the present invention which have been described with reference to FIGS. 5, 6, 9 and 10, the permanent magnet 13 and the contact gap reduction unit 14 are disposed in such a manner as to face each other across the reed member set 10. Therefore, it is necessary for the housing 15 to have a capacity containing the installation space of the reed member set 10 and permanent magnet 13 as well as the movable and installation space of the contact gap reduction unit 14.

In the case of the third embodiment, the permanent magnet 13 and contact gap reduction unit 14 are disposed in such a manner as to be on the same side of the reed member set 10, as shown in FIG. 11. As the mentioned above, the permanent magnet 13 is disposed on the housing 15 via the support 18. Thus, since the installation space of the contact gap reduction unit 14 of the first and second embodiments, that is, the space facing the permanent magnet 13 across the reed member set 10, can be reduced, the housing 15 can be further miniaturized.

Figure 12:
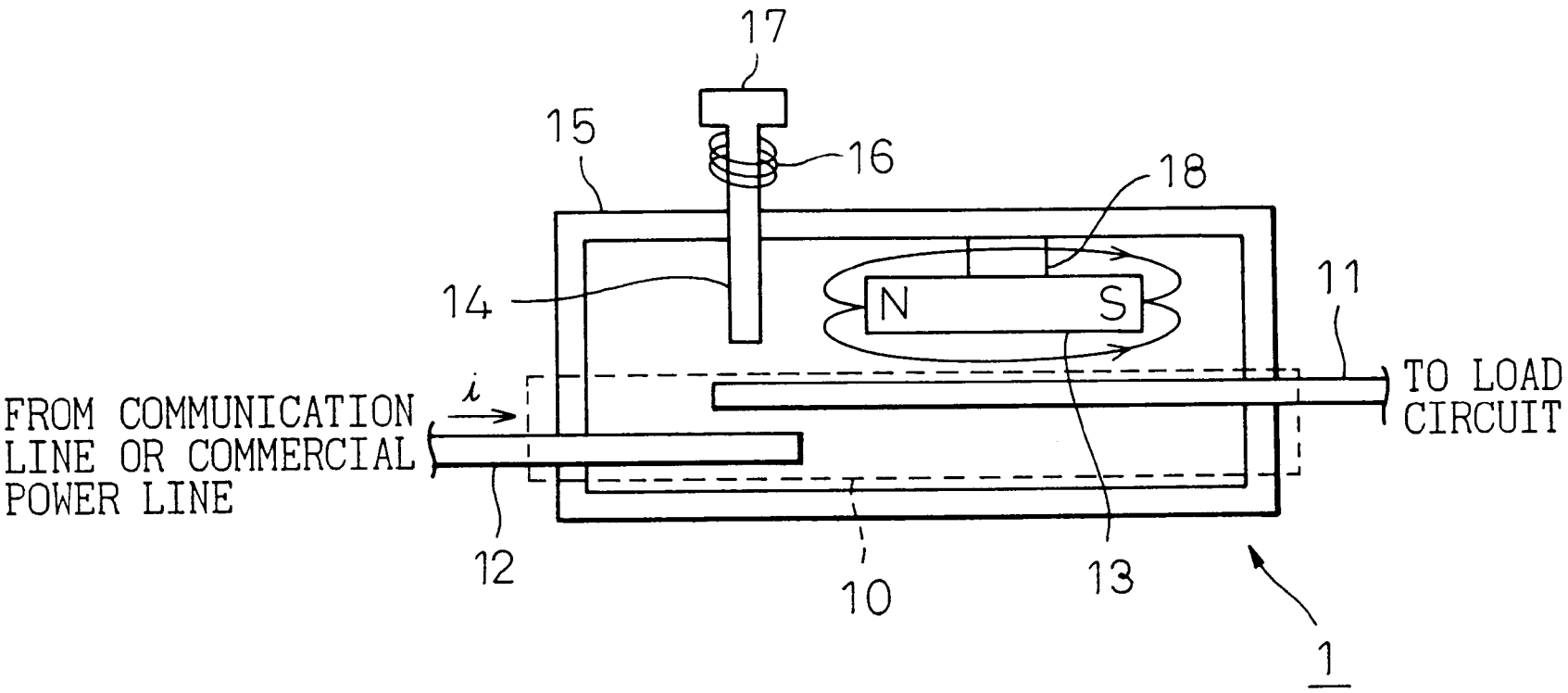
FIG. 12 is a top view of a circuit protection device according to an alternative to the third embodiment of the present invention.

FIG. 12 is a top view of a circuit protection device according to an alternative of the third embodiment of the present invention.

As mentioned above, in the circuit protection device 1 shown in FIG. 11, the permanent magnet 13 is disposed in the vicinity of the gap provided on the first reed member 11 and the second reed member 12, and the contact gap reduction unit 14 is disposed in such a manner as to depress a point which is apart from the contact in the vicinity of the first reed member 11.

According to an alternative to the third embodiment, as shown in FIG. 12, the contact gap reduction unit 14 is disposed in such a manner as to depress a point on the first reed member 11 which is in the vicinity of the gap between the first reed member 11 and the second reed member 12. Further, the permanent magnet 13 is disposed away from the gap. Thus, according to this alternative, since the permanent magnet 13 is disposed further away from the gap between the first reed member 11 and the second reed member 12 than in the case of the third embodiment shown in FIG. 11, the magnitude of the holding magnetic field, for maintaining a state in which the end of the contacts of the reed members are in contact with each other, must be increased.

As described above, according to the third embodiment of the present invention, since the permanent magnet and the contact gap reduction unit are disposed in such a manner as to face each other across the reed member set, the housing can be further miniaturized, and thereby the circuit protection device can be more freely installed.

Next, another circuit protection device, which is a fourth embodiment of the present invention, will be described hereunder.

As described above, the circuit protection device of the first, second and third embodiment of the present invention is adapted so that when the magnitude of the circuit current flowing through the load circuit to be protected is not less than a predetermined value, the contacts of the reed members open, even though these contacts have been maintained in a state in which the contacts are in contact with each other.

In the case of the fourth embodiment, the circuit protection device can be applied to protecting a circuit more surely against a surge with a large energy such as a lightning surge. Namely, the fourth embodiment further comprises a surge arrester (a surge absorber), which disposed in at least one end of the reed member set, in addition to constituent elements of the first, second or third embodiment.

Figure 13:
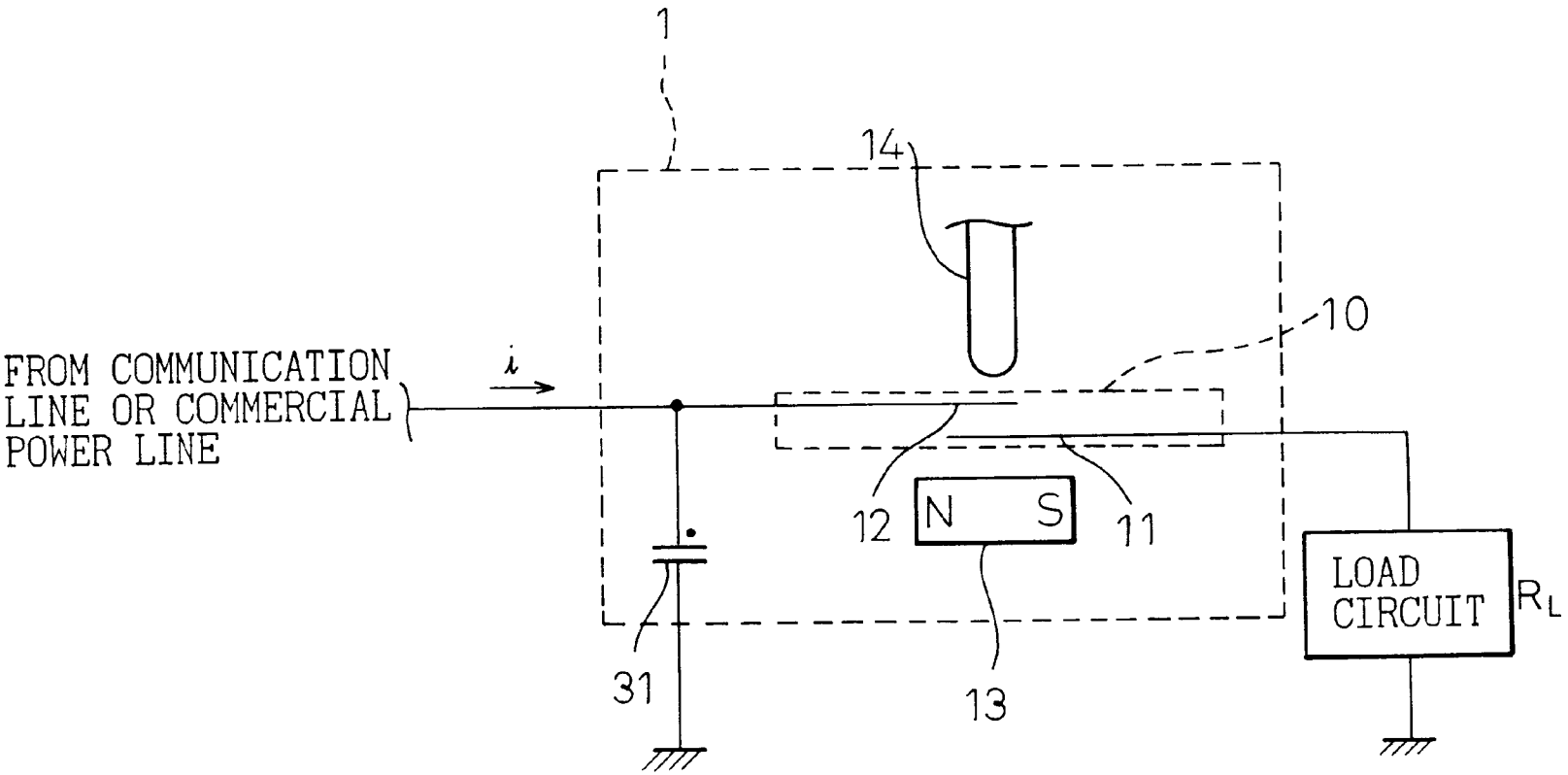
FIG. 13 is a circuit diagram illustrating a fourth embodiment of the present invention.

FIG. 13 is a circuit diagram illustrating a fourth embodiment of the present invention.

The constituent elements, functions, operations, features, and alternatives other than the surge arrester are similar to the corresponding ones of the above-mentioned embodiments and are thus omitted herein. FIG. 13 shows the circuit protection device 1 according to the fourth embodiment in the form of the circuit diagram, schematically. For simplicity of description, the housing 15, the spring 16, the button 17 and the support 18 are omitted therein. The overcurrent i owing to various kinds of surges or sparks is assumed to flow in the direction of the arrow in this figure.

As shown in FIG. 13, the circuit protection device according to the fourth embodiment comprises the reed member set 10 having the first reed member 11 and the second reed member 12, the permanent magnet 13, which serves as the magnetic-field generation unit, the contact gap reduction unit 14 and the surge arrester 31.

The second reed member 12 of the reed member set 10 is connected to the surge arrester in parallel with the reed member set 10 and the load circuit $R_L$. The first reed member 11 of the reed member set 10 is connected to the load circuit $R_L$ to be protected.

In the case of this embodiment, the surge arrester 31 has, for example 400 to 550 Volts as the operating voltage. Further, the surge arrester 31 can withstand a 2,500 Ampere current once in the case of a 8/20 $\mu$s pulse current flowing therein and to withstand 200 Ampere current twenty times in the case of a 10/200 $\mu$s pulse current flowing therein (IEC1000-4-5, VDE0878, C62.41), for example.

The example of the surge arrester 31 employed in this embodiment is a metallic oxide (for example, zinc oxide) varistor, a lightning arrester (gas tube arrester), a diode type arrester employing silicon PN junction under voltage control, a thyristor type arrester composed of a silicon PNPN junction under current control, a PTC thermistor type arrester and so on.

The metal oxide varistor is a voltage-dependent resistor and is used widely for voltage stability or reduction of the extraordinary voltage owing to the non-ohmic characteristics thereof. Particularly, the zinc oxide varistor has good non-ohmic characteristics and a large surge current withstand.

The lightning arrester (gas tube arrester) is a discharge tube having two or three poles, which makes use of an electric discharge in an inert gas such as argon. The lightning arrester has no leakage current, but has a small capacitance and can withstand a large surge current.

The diode type arrester employing a silicon PN junction under voltage control has a very high response speed due to the avalanche effect and can withstand a large surge current.

The thyristor type arrester composed of silicon PNPN junction under current control can maintain a certain clamping voltage even if pulse occurs. Further, the thyristor type arrester does not deteriorate with age, that is, it is stable.

The PTC thermistor type arrester is a temperature-dependent resistor whose main component is barium titanate. When more than a certain current flows through the PTC thermistor type arrester, the temperature of the PTC thermistor type arrester reaches the switching temperature due to Joule heating after a certain time goes by and then the resistance of the PTC thermistor type arrester increases, and thereby the current is controlled. The excessive current can be limited owing to this characteristic.

The operation of a circuit protection device which is a fourth embodiment of the present invention, will be described hereunder.

As shown in FIG. 13, the surge arrester 31 is connected to the second reed member 12 of the reed member set 10, in parallel to the reed member set 10 and the load circuit $R_L$. When an overcurrent i owing to various kinds of surges or sparks flows in the direction of the arrow in this figure, the overcurrent i is shunted based on the ratio of the resistance of the surge arrester 31 to the resistance of the reed member set 10 and the load circuit $R_L$. Usually, since the resistance of the surge arrester 31 (i.e., resistance at the time the surge arrester is ON) is smaller than that of the reed member set 10 and the load circuit $R_L$, most of the overcurrent i flows through the surge arrester 31. Namely, since the circuit protection device of this embodiment comprises the surge arrester 31, the overcurrent i flowing through the reed member set 10 can be depressed, and it can withstand a larger surge current than that of the first, second or third embodiment. Further, the higher response speed the surge arrester 31 has, the more reliably the interrupting operation against the surge current is performed.

Lightning surges with a large energies usually arrive as consecutive pulses, the magnitude of which becomes bigger and bigger. In such a case, according to this embodiment, when the surge current in the first stage flows through the load circuit $R_L$, the first reed member 11 and the second reed member 12 open, so that the load circuit is interrupted. When the surge current in the additional stage flows through the load circuit after the contacts of the reed members have opened, the load circuit $R_L$ can be protected owing to the contact gap which resulted from the open contact. In this case, even if a lightning surge has a very large energy, which is over the interrupting performance of the reed member set 10, the surge arrester 31 absorbs the surge current and thereby the load circuit $R_L$ can be protected more surely. As described above, according to the fourth embodiment of the present invention, since the interrupting operation is performed by utilizing the principle of the surge arrester together with the principle of the reed switch, the load circuit can be protected more surely.

Next, another circuit protection device, which is a fifth embodiment of the present invention, will be described hereunder.

As described above, the circuit protection device of the first, second, third and fourth embodiment of the present invention is adapted for a state in which the overcurrent owing to various kinds of surges or sparks flows in one direction for the circuit protection device according to the present invention. Namely, as described with reference to FIG. 1, it is supposed that the overcurrent i owing to various kinds of surges or sparks flows from the second reed member 12 to the first reed member 11. In this case, the magnetic poles of the magnetic-field generating unit 13 are configured in such a manner as to be N-S along the second reed member 12 and the first reed member 11, in order. Namely, the magnetic-field generating unit 13 is configured in the vicinity of the first reed member 11 and the second reed member 12 in such a way that the direction of a component of magnetic lines of flux generated by the magnetic-field generating unit 13, which is parallel to these reed members 11 and 12, matches to the direction of the overcurrent i flowing through these reed members 11 and 12 which are in contact with each other.

Generally speaking, the polarity of the lightning surge voltage varies depending on weather conditions, season, geographical features and the other condition. The direction of the actual overcurrent owing to various kinds of surges is not limited to the herein-above-described one direction. In the case of the fifth embodiment, the circuit protection device can be applied independently of the direction of the overcurrent owing to various kinds of surges or sparks. Namely, according to the fifth embodiment, the arrangement of the magnetic poles of the magnetic-field generating unit is not the herein-above-described two poles, i.e., N-S but three poles, i.e., N-S-N or S-N-S.

Figure 14:
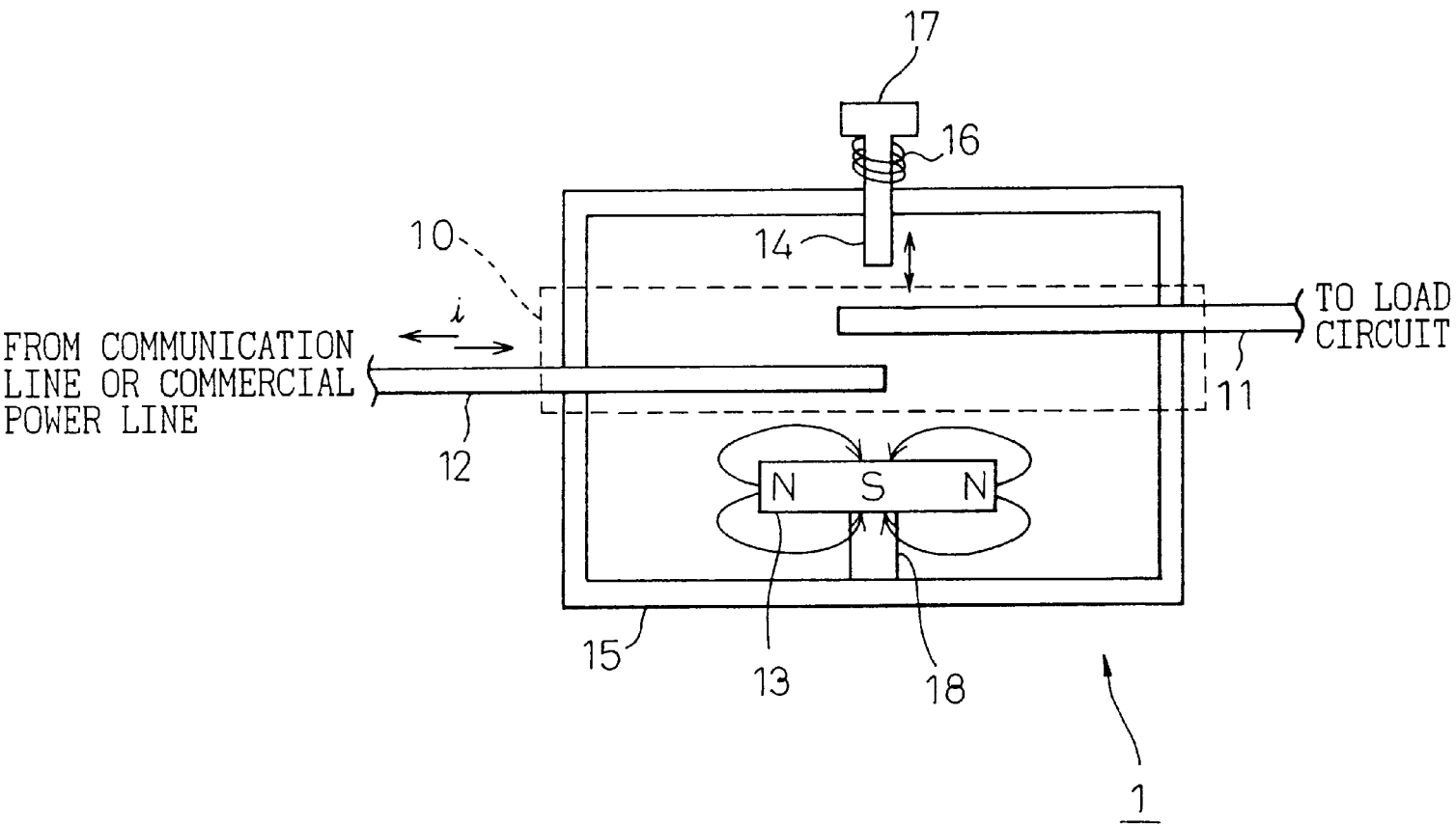
FIG. 14 is a top view of a circuit protection device according to a fifth embodiment of the present invention.

FIG. 14 is a top view of a circuit protection device according to a fifth embodiment of the present invention. The constituent elements, functions, operations, features, and alternatives other than the magnetic pole of the magnetic-field generation unit are similar to the corresponding ones of the above-mentioned embodiments and are thus omitted herein. The overcurrent i owing to various kinds of surges or sparks is assumed to flow in the direction of the arrows in this figure, that is, in two directions. The first reed member 11 is connected to the load circuit to be protected, and the second reed member 12 is connected to communication lines or commercial power lines.

As shown in FIG. 14, the magnetic poles of the permanent magnet 13 of the circuit protection device 1 according to this embodiment are N-S-N. Similar to the above-mentioned embodiments, the permanent magnet 13 is disposed on the housing 15 via the support 18 in the vicinity of the gap provided between the first reed member 11 and the second reed member 12. As described above, according to the operating principle of the reed switch, in the case that the direction of the component of magnetic lines of flux generated by the permanent magnet 13, which is parallel to these reed members 11 and 12, does not match the direction of the overcurrent i flowing through these reed members 11 and 12 which are in contact with each other, although the overcurrent i flows, the contacts respectively provided on these reed members 11 and 12 do not open. According to this embodiment, since the magnetic poles of the permanent magnet 13 of the circuit protection device 1 are, N-S-N, the permanent magnet 13 generates the magnetic lines of flux in two directions along these reed members 11 and 12. Therefore, whichever direction the overcurrent i flows, the contacts of these reed members 11 and 12 can open. Thus, according to this embodiment, the contacts of these reed members 11 and 12 which have been in contact with each other by a holding magnetic field, can open when the overcurrent i flows through the circuit protection device 1, independently of the direction of the overcurrent i.

Incidentally, the arrangement of the magnetic poles of the permanent magnet 13 may be not only N-S-N but may also be S-N-S. If the arrangement of the magnetic poles of the permanent magnet 13 of the above-mentioned embodiments is not N-S but N-S-N or S-N-S, the contacts of these reed members 11 and 12 which have been in contact with each other by a holding magnetic field can open when the overcurrent i flows through the circuit protection device 1, independently of the direction of the overcurrent i.

Next, another circuit protection device, which is a sixth embodiment of the present invention, will be described hereunder.

In the case of the sixth embodiment, the circuit protection device can protect a circuit more surely against a surge with a large energy such as a lightning surge, and the interrupting operation can be performed independently of the direction of the overcurrent. Namely, the sixth embodiment is realized by combining the above-mentioned fourth and fifth embodiment.

Figure 15:
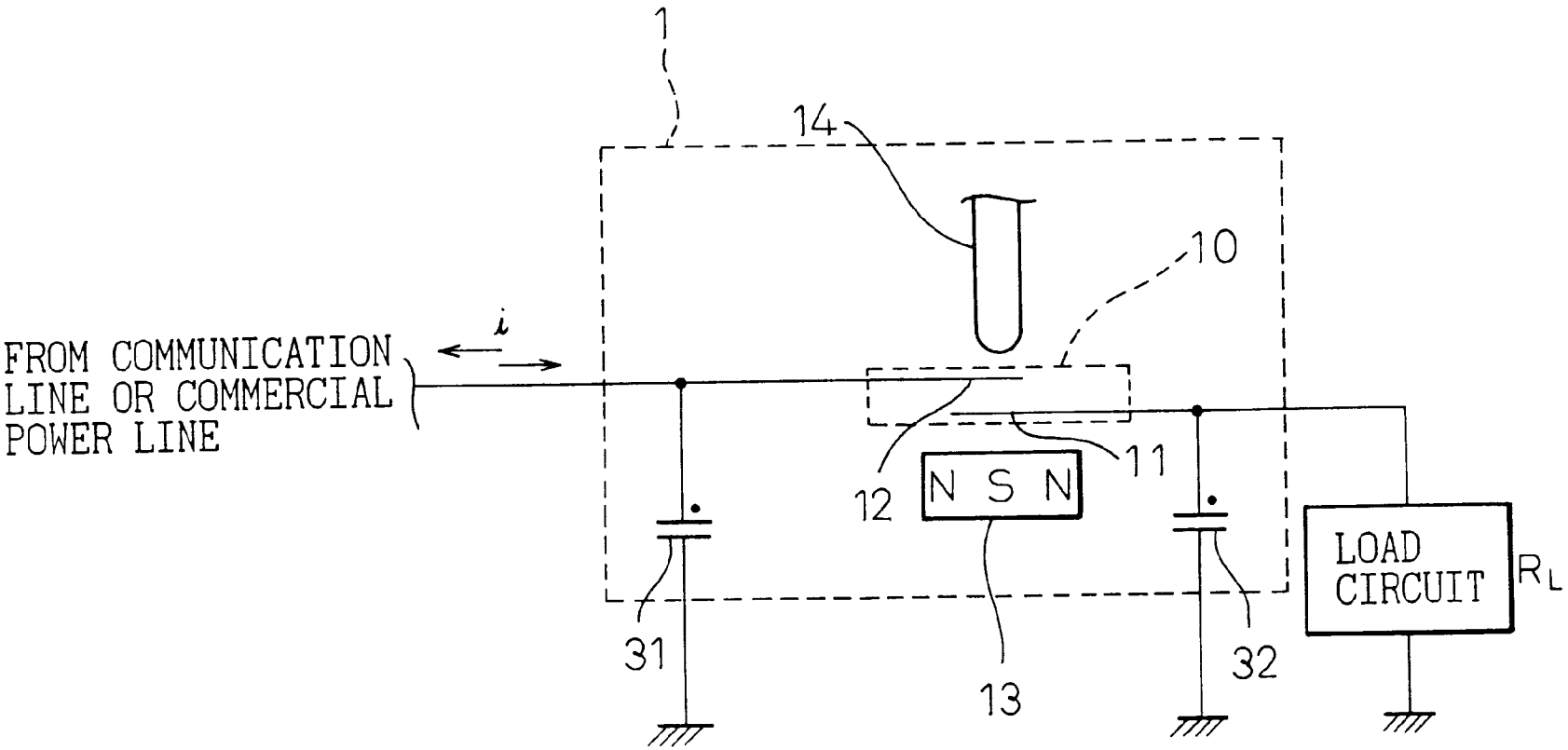
FIG. 15 is a circuit diagram illustrating a sixth embodiment of the present invention.

FIG. 15 is a circuit diagram illustrating a sixth embodiment of the present invention.

As shown in FIG. 15, the circuit protection device according to the sixth embodiment comprises the reed member set 10 having the first reed member 11 and the second reed member 12, the permanent magnet 13, which serves as the magnetic-field generation unit, the contact gap reduction unit 14 and the surge arrester 31. Incidentally, for simplicity of description, FIG. 15 shows the circuit protection device 1 according to the fourth embodiment in the form of the circuit diagram, schematically. The housing 15, the spring 16, the button 17 and the support 18 are omitted therein. Moreover, the constituent elements, functions, operations, features, and alternatives other than the magnetic pole of the magnetic-field generation unit and the surge arrester are similar to the corresponding ones of the above-mentioned embodiments and are thus omitted herein. It is assumed that the overcurrent i owing to various kinds of surges or sparks flows in the direction of the arrows in this figure, i.e., in two directions.

The first reed member 11 is connected to the load circuit to be protected and to the surge arrester 32 in parallel to the load circuit $R_L$. The second reed member 12 of the reed member set 10 is connected to the surge arrester 31 in parallel with the reed member set 10 and the load circuit $R_L$. The second reed member 12 is connected to communication lines or commercial power lines.

As shown in FIG. 15, the magnetic poles of the permanent magnet 13 of the circuit protection device 1 according to this embodiment are N-S-N. Similarly to the above-mentioned embodiments, the permanent magnet 13 is disposed on the housing 15 via the support 18 in the vicinity of the gap provided between the first reed member 11 and the second reed member 12. The arrangement of the magnetic poles of the permanent magnet 13 may be not only N-S-N but also S-N-S.

Thus, according to this embodiment, the contacts of the reed members 11 and 12 which have been in contact with each other due to a holding magnetic field can open when the overcurrent i flows through the circuit protection device 1, independently of the direction of the overcurrent i for the same reasons as those of the fifth embodiment.

If the surge has a very large energy, above the interrupting performance of the reed member set 10, owing to the surge arresters 31 and 32 provided on both ends of the reed member set 10, the overcurrent i flowing through the reed member set 10 can be limited independently of the direction of the overcurrent i for the same reasons as those of the fifth embodiment. Thus, the circuit protection device has a larger surge current withstand than that of the fifth embodiment. Further, the higher the response speed that the surge arresters 31 and 32 have, the more reliably the interrupting operation against the surge current is performed.

As described above, according to the sixth embodiment of the present invention, since the interrupting operation is performed by utilizing the principle of the surge arrester together with the principle of the reed switch, the load circuit can be protected more surely. Further, since the arrangement of the magnetic poles of the magnetic-field generation unit is N-S-N or S-N-S, the interrupting operation against the surge current is surely performed dependently of the polarity of the surge voltage.

Next, another circuit protection device, which is a seventh embodiment of the present invention, will be described hereunder.

According to the seventh embodiment of the present invention, at least two sets of reed members are arranged side by side, of which the reed members arranged side by side are connected each other in such a way that the at least two sets of reed member set are connected in series with each other.

Figure 16:
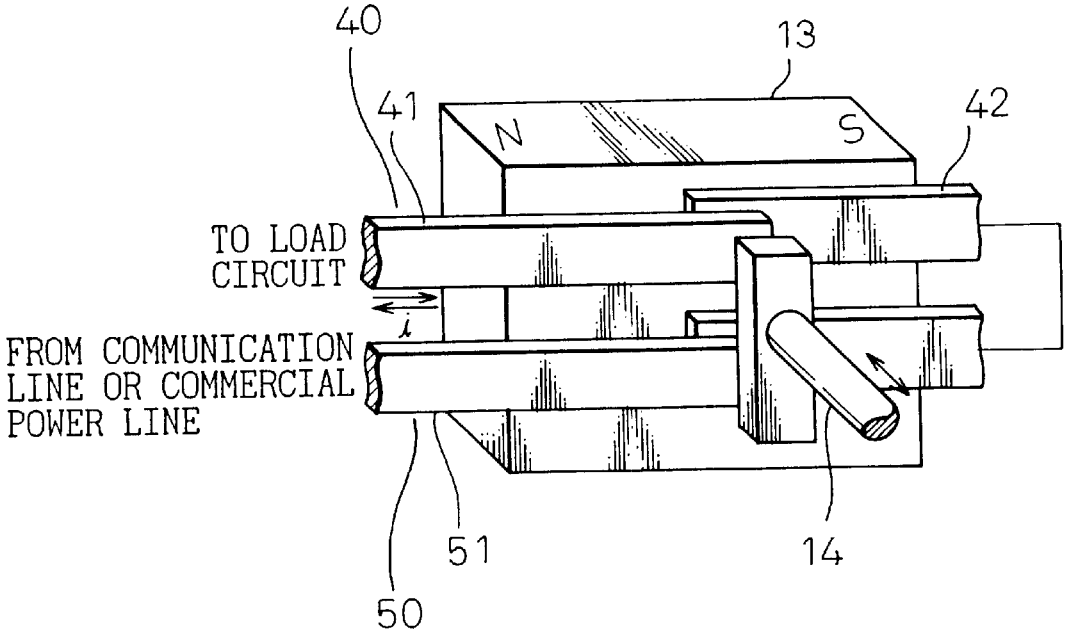
FIG. 16 is a perspective view of a circuit protection device according to a seventh embodiment of the present invention.

FIG. 16 is a perspective view of a circuit protection device according to a seventh embodiment of the present invention.

The circuit protection device 1 according to the seventh embodiment comprises a first reed member set 40 having a first reed member 11 and a second reed member 12, a second reed member set 50, having a third reed member 51 and a fourth reed member 52, which is arranged at the side of the first reed member set 40, the permanent magnet 13, which serves as the magnetic-field generation unit and the contact gap reduction unit 14. The constituent elements, functions, operations, features, and alternatives other than the magnetic pole of the magnetic-field generation unit and the surge arrester are similar to the corresponding ones of the above-mentioned embodiments and are thus omitted herein. Moreover, for simplicity of description, FIG. 16 shows the circuit protection device 1 according to the fourth embodiment in the form of the circuit diagram, schematically. The housing 15, the spring 16, the button 17 and the support 18 are omitted therein. It is supposed that the overcurrent i owing to various kinds of surges or sparks flows in the direction of the arrows in this figure, i.e., in two directions.

According to this embodiment, as shown in FIG. 16, the first reed member set 40 and the second reed member set 50 are arranged side by side, over the permanent magnet 13. Both ends of each of the first reed member set 40 and the second reed member set 50 are fixed to the housing 15 (not shown).

The first reed member 41 of the first reed member set 40 is connected to the load circuit to be protected. The third reed member 51 of the second reed member set 50 is connected to communication lines or commercial power lines. Moreover, the second reed member 42 of the first reed member set 40 is connected to the fourth reed member 52 of the second reed member 50 which is arranged at the side of the second reed member 42, so that the first reed member set 40 and the second reed member set 50 are connected to each other in series. As described above, the circuit protection device according to this embodiment has two sets of reed members. Moreover, the circuit protection device may have more than two sets of reed members. In such a case, the reed members arranged side by side are connected each other in such a way that the plural sets of reed member set are connected to each other in series.

Figure 17:
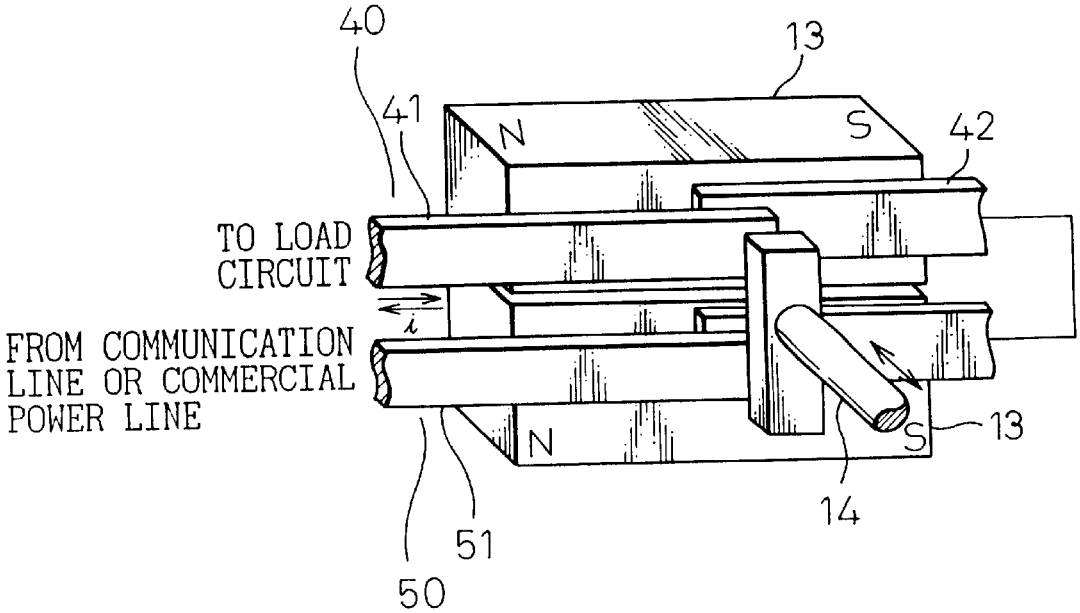
FIG. 17 is a perspective view of a circuit protection device according to alternative to the seventh embodiment of the present invention.

The permanent magnet 13 is deposed on the inner wall portion of the housing 15 (not shown) via the support 18 (not shown), in the vicinity of the contacts respectively provided on the first reed member 41, the second reed member 42, the third reed member 51 and the fourth reed member 52. Namely, the permanent magnet 13 is disposed in such a way that the direction of the component of magnetic lines of flux generated by the permanent magnet 13, which is parallel to these reed members 41, 42, 51 and 52, matches the direction of the overcurrent i flowing through these reed members 41, 42, 51 and 52 which are in contact with each other. As shown in FIG. 17, a plurality of permanent magnets may be provided for every reed member set.

A state, in which the first reed member 41 and the second reed member 42 as well as the third reed member 51 and the fourth reed member 52 are attracted to each other, is maintained by a holding magnetic field that is generated by the permanent magnet 13. Thus, an electric current conducting path i.e., a main current conducting path is formed for a circuit current flowing through the load circuit $R_L$ via the first reed member 41, the second reed member 42, the fourth reed member 52 and the third reed member 51.

The contact gap reduction unit 14 is made of a non-magnetic material, and is disposed in the proximity of the contacts respectively provided on the first reed member set 40 and the second reed member set 50. Since the circuit protection device 1 according to this embodiment has a plurality of reed member sets, the contact gap reduction unit 14 is disposed in such a manner that the contact gap reduction unit 14 can depress the first reed member 41 and the third reed member 51 at the same time, as shown in FIG. 16. Similarly to the above-mentioned embodiments, the spring 16 is provided between a button 17 (not shown) of the contact gap reduction unit 14 and the outer wall portion of the housing 15 (not shown). The contact gap reduction unit 14 is moved upwardly and downwardly in the direction of these reed members 41, 42, 51 and 52 by depressing the button 17 or canceling the depression of the button 17.

Figure 18:
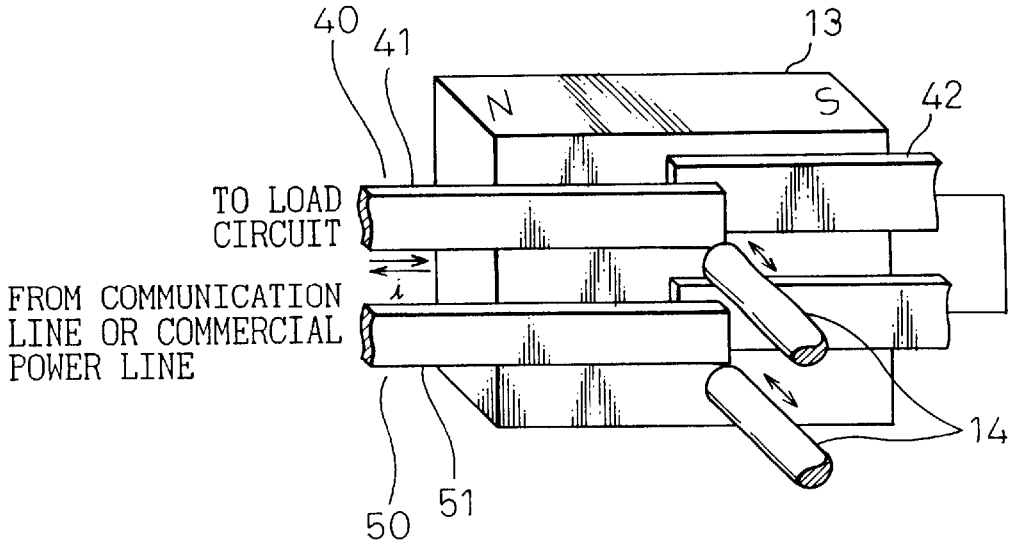
FIG. 18 is a diagram illustrating an alternative contact gap reduction unit according to the seventh embodiment of the present invention.

FIG. 18 is a diagram illustrating an alternative contact gap reduction unit according to the seventh embodiment of the present invention. As shown in this figure, the plural contact gap reduction units may be provided on every reed member sets, respectively.

As long as the contact gaps respectively provided by the first reed member set 40 and the second reed member set 50 can be decreased, the structure of the aforementioned contact gap reduction unit 14 is not limited to the herein-above-described one. The contact gap reduction unit 14 may have, for example, a structure in which the contact gap is decreased by using a plunger and depressing a button part provided thereon or, alternatively, a structure in which the contact gap is reduced by driving the plunger by the use of a motor.

As described above, according to this embodiment, the plural reed member sets are connected each other in series, and thereby the interrupting operation is surely performed in dependence of the direction of the overcurrent i flowing through the circuit protection device. For example, in the case that the overcurrent i flows from the first reed member 41 of the first reed member set 40, since the direction of the component of magnetic lines of flux generated by the permanent magnet 13, which is parallel to these reed members 41, 42, 51 and 52, matches the direction of the overcurrent i flowing through the first reed member set 40, the contacts respectively provided on the first reed member 41 and the second reed member 42 of the first reed member set 40 will open. For another example, in the case that the overcurrent i flows from the third reed member 51 of the second reed member set 50, since the direction of the component of magnetic lines of flux generated by the permanent magnet 13, which is parallel to these reed members 41, 42, 51 and 52, matches the direction of the overcurrent i flowing through the second reed member set 50, the contacts respectively provided on the third reed member 51 and the fourth reed member 52 of the second reed member set 50 will open.

According to the seventh embodiment of the present invention, when the overcurrent i flows through the circuit protection device 1, one of either the first reed member set or the second reed member set, which corresponds to the direction of the overcurrent i, will open. Namely, the interrupting operation can be performed independently of the direction of the overcurrent. Moreover, as the aforementioned second embodiment, the circuit protection device can cope with the case in which a large circuit current flows through the circuit, by being provided with an additional current shunting path, i.e., a shunting conductive path in every reed member set. Moreover, as the aforementioned fourth or sixth embodiment, if the surge arrester is further disposed in at least one end of the reed member set, the reliability of the interrupting operation against the surge current become higher. In such a case, the more surge arresters there are, the more reliably the interrupting operation against the surge current is performed. Some of the above-mentioned alternatives of the seventh embodiment may properly combine to realize the circuit protection device.

Next, another circuit protection device, which is an eighth embodiment of the present invention, will be described hereunder.

According to the eighth embodiment of the present invention, similarly to the seventh embodiment, at least two sets of reed members are arranged side by side, of which the reed members arranged side by side are connected each other in such a way that the at least two sets of reed member set are connected in series with each other, and further the reed members arranged side by side are combined each other via insulated members.

Figure 19:
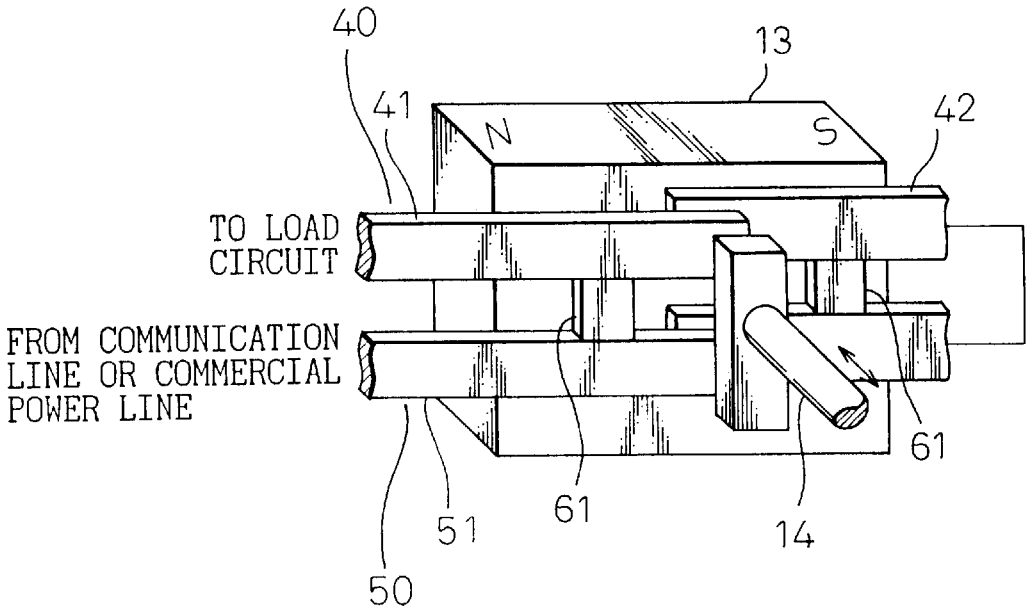
FIG. 19 is a perspective view of a circuit protection device according to an eighth embodiment of the present invention.

FIG. 19 is a perspective view of a circuit protection device according to an eighth embodiment of the present invention.

The constituent elements, functions, operations, features, and alternatives other than the insulated members combining the reed members arranged side by side each other are similar to the corresponding ones of the above-mentioned embodiments and are thus omitted herein. Moreover, for simplicity of description, the housing 15, the spring 16, the button 17 and the support 18 are omitted in this figure.

According to this embodiment, the reed members arranged side by side are also combined each other via the insulated members 61, as shown in FIG. 19. Namely, the first reed member 41 and the third reed member 51 are combined via the insulated members 61, and also the second reed member 42 and the fourth reed member 52 are combined via the insulated members 61. Similarly to the aforementioned seventh embodiment, the interrupting operation according to the eighth embodiment can be performed independently of the direction of the overcurrent. Particularly, the eighth embodiment is characterized in that when the overcurrent i flows through the circuit protection device 1 and then the one of either the first reed member set or the second reed members, which corresponds to the direction of that overcurrent i, opens accordingly, the insulated members 61 for combining the reed members, each of which is arranged side by side, forces another reed member set to open. This means that, according to the eighth embodiment, when performing an interrupting operation and opening the contacts, the contact gap is twice as long as that of the aforementioned embodiments. Therefore, the circuit protection device can withstand a larger surge current than the seventh embodiment. Incidentally, since the actual contact gap of the reed member sets according to the eighth embodiment is equal to that of the aforementioned embodiments, the reed members can be attracted to each other by using the aforementioned permanent magnet 13 and contact gap reduction unit 14 in the same manner.

As described above, according to the eighth embodiment of the present invention, when the overcurrent i flows through the circuit protection device 1 and then the one of either the first reed member or the second reed member, which corresponds to the direction of that overcurrent i, opens accordingly, the insulated members forces the other reed member set to open. Namely, the interrupting operation can be performed more surely and independently of the direction of the overcurrent. Moreover, as in the aforementioned second embodiment, the circuit protection device can cope with the case in which a large circuit current flows through the circuit, by being provided with an additional current shunting path, i.e., a shunting conductive path in every reed member set. Moreover, as the aforementioned fourth or sixth embodiment, if the surge arrester is further disposed in at least one end of the reed member set, the reliability of the interrupting operation against the surge current becomes higher. In such a case, the more surge arresters there are, the more reliably the interrupting operation against the surge current is performed. Some of the above-mentioned alternatives of the eighth embodiment may properly combine to realize the circuit protection device.

Next, another circuit protection device, which is a ninth embodiment of the present invention, will be described hereunder.

The circuit protection device according to the ninth embodiment can protect a load circuit comprising two-line cable, e.g., twisted pair. Namely, according to this embodiment, a load circuit to be protected is connected between one end of each of at least two sets of said reed members arranged side by side.

Figure 20:
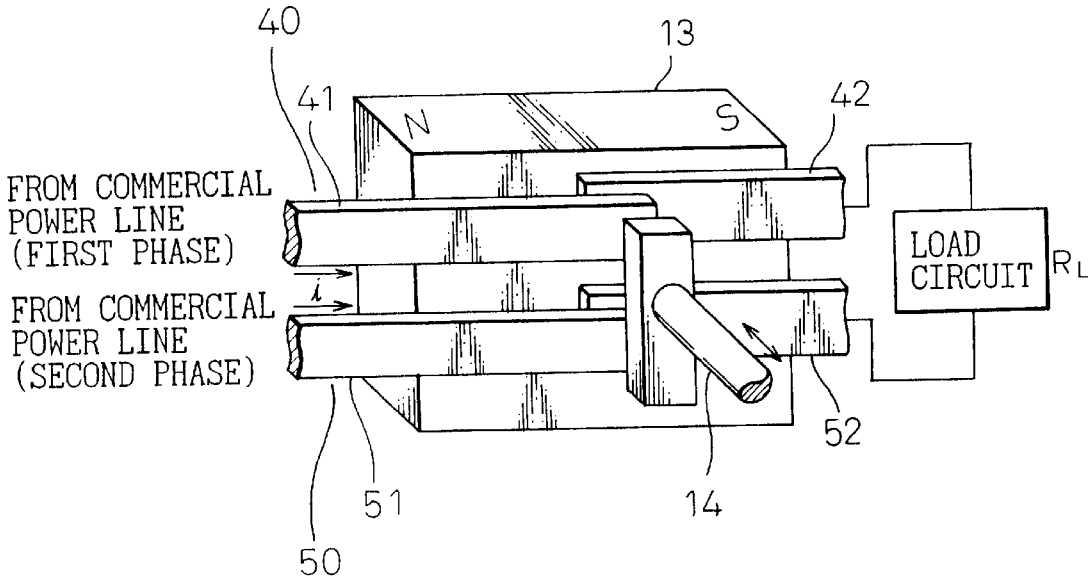
FIG. 20 is a perspective view of a circuit protection device according to a ninth embodiment of the present invention.

FIG. 20 is a perspective view of a circuit protection device according to a ninth embodiment of the present invention.

The circuit protection device 1 according to the ninth embodiment comprises the first reed member set 40 having the first reed member 11 and the second reed member 12, the second reed member set 50 having the third reed member 51 and the fourth reed member 52, the permanent magnet 13, which serves as the magnetic-field generation unit, and the contact gap reduction unit 14, similarly to the above-mentioned seventh embodiment. In the case of the ninth embodiment, the load circuit $R_L$ is connected between the second reed member 42 and the fourth reed member 52. Further, the first reed member 41 and the third reed member 51 are connected to, for example commercial power lines, respectively.

The constituent elements, functions, operations, features, and alternatives are similar to the corresponding ones of the above-mentioned embodiments and thus omitted herein. Moreover, for simplicity of description, the housing 15, the spring 16, the button 17 and the support 18 are omitted in this figure.

When the overcurrent i, owing to various kinds of surges or sparks flows, through the first reed member set 40 and/or the second reed member set 50, in the direction of the arrow in this figure, the reed members of the corresponding reed member set open, so that the load circuit $R_L$ is interrupted.

When the overcurrent flows through either line of the two-line cable, the corresponding reed member set opens accordingly and also the insulated members between the reed member sets arranged side by side forces another reed member set to open. Namely, the interrupting operation can be performed more surely and independently of the direction of the overcurrent. Moreover, as the aforementioned second embodiment, the circuit protection device can cope with the case in which a large circuit current flows through the circuit, by being provided with an additional current shunting path, i.e., a shunting conductive path, in every reed member set. Moreover, as the aforementioned fourth or sixth embodiment, if the surge arrester is further disposed in at least one end of the reed member set, the reliability of the interrupting operation against the surge current become higher. In such a case, the more surge arresters there are, the more reliably the interrupting operation against the surge current is performed. Further, if the arrangement of the polarity of the magnetic-field generation unit is N-S-N or S-N-S, the interrupting operation against the surge current is more surely performed dependently of the direction of the overcurrent i. Some of the above-mentioned alternatives of the eighth embodiment may properly combine to realize the circuit protection device.

In the case of the ninth embodiment, a load circuit comprising two-line cable, i.e., a twisted pair is described. Moreover, the circuit protection device according to this embodiment can be applied with multiple phase lines of commercial power lines. For example, it may be three phase lines. In such a case, three sets of reed members are arranged side by side. The constituent elements, functions, operations, features, and alternatives are similar to corresponding ones in the case of the above-mentioned two-line cable.

As described above, according to the ninth embodiment of the present invention, only one circuit protection device of the present invention can protect the load circuit comprising multi-lines cable. According to the prior art, in order to protect the load circuit comprising multi-lines cable, a circuit protection device should be provided in every line. However, according to the ninth embodiment, since the circuit protection device comprises plural reed members therein, the installation space and the cost of manufacturing the circuit protection device can be reduced.

As described above, according to the present invention, a sufficient contact gap for interrupting overcurrent conditions due to various kinds of surges or sparks can be freely ensured in the circuit protection device using the reed members. Thus, the circuit protection device is realized in such a manner as to have a simple structure and to be small in size and weight. Further, the operations of this circuit protection device are only the opening and closing operations of the reed members. Therefore, the response speed of this circuit protection device is high. Consequently, even after an interrupting operation is once performed so as to protect the circuit from an overcurrent, the circuit protection device is easily reset by only operating the contact gap reduction unit. Hence, the circuit protection device of the present invention can withstand repetitive use.

Moreover, the circuit protection device can cope with the case in which a large circuit current flows through the circuit, by being provided with an additional current shunting path, i.e., a shunting conductive path. Thus, for example, in a communication devices, the circuit protection device can be used not only a signal line but also a power line. In the case that the interrupting operation is performed by utilizing the principle of the surge arrester together with the principle of the reed switch, the load circuit can be protected more surely. Further, the interrupting operation against the surge current is also performed independently of the polarity of the surge voltage. Moreover, only one circuit protection device of the present invention can protect a load circuit comprising multi-line cable.

Although the preferred embodiments of the present invention have been described above, it should be understood that the present invention is not limited thereto and that other modifications will be apparent to those skilled in the art without departing from the sprint of the invention.

The scope of the present invention, therefore, should be determined solely by the appended claims.

What is claimed is:

1. A circuit protection device comprising:

at least one set of reed members having a pair of reed members, wherein each of the reed members is constituted by a magnetic material and disposed in such a way as to be opposed to the other of said reed members and has an end disposed in such a manner as to be apart by a predetermined gap from and contactable with an end of the other of said reed members;

a magnetic-field generating unit placed in vicinity of the reed members set and adapted to generate a holding magnetic field for maintaining a state, in which the end of said reed members are in contact with each other, after the ends of said reed members are attracted to each other, and said ends are closed; and a contact gap reduction unit for reducing the gap to a gap corresponding to a pull-in of the magnetic field generated by said magnetic-field generating unit, the contact gap reduction unit contacting one of the reed members.

2. The circuit protection device according to claim 1, wherein magnetic poles of said magnetic-field generating unit are configured in such a manner as to be N-S or S-N in order.

3. The circuit protection device according to claim 1, wherein said magnetic-field generating unit and said contact gap reduction unit are disposed in such a manner as to face each other across said reed member set.

4. The circuit protection device according to claim 1, wherein said magnetic-field generating unit and said contact gap reduction unit are disposed in such a manner as to be on the same side of said reed member set.

5. The circuit protection device according to claim 1, wherein said magnetic material is an iron-nickel alloy.

6. A circuit protection device comprising:

at least one set of reed members having a pair of reed members, wherein each of the reed members is constituted by a magnetic material and disposed in such a way as to be opposed to the other of said reed members and has an end disposed in such a manner as to be apart by a predetermined gap from and contactable with an end of the other of said reed members;

a magnetic-field generating unit placed in a vicinity of the reed members set and adapted to generate a holding magnetic field for maintaining a state, in which the end of said reed members are in contact with each other, after the ends of said reed members are attracted to each other, and said ends are closed; and a contact gap reduction unit for reducing the gap to a gap corresponding to a pull-in of the magnetic field generated by said magnetic-field generating unit, wherein said reed member set arranged side by side is at least two sets of the reed members which are connected in series with each other.

7. The circuit protection device according to claim 6, wherein said magnetic-field generating unit is provided for every reed member set.

8. The circuit protection device according to claim 6, wherein said contact gap reduction unit is provided for every reed member set.

9. A circuit protection device comprising:

at least one set of reed members having a pair of reed members, wherein each of the reed members is constituted by a magnetic material and disposed in such a way as to be opposed to the other of said reed members and has an end disposed in such a manner as to be apart by a predetermined gap from and contactable with an end of the other of said reed members;

a magnetic-field generating unit placed in a vicinity of the reed members set and adapted to generate a holding magnetic field for maintaining a state, in which the end of said reed members are in contact with each other, after the ends of said reed members are attracted to each other, and said ends are closed; and a contact gap reduction unit for reducing the gap to a gap corresponding to a pull-in of the magnetic field generated by said magnetic-field generating unit, wherein a load circuit to be protected is connected between one end of each of at least two sets of said reed members arranged side by side.

10. The circuit protection device according to claim 9, wherein said magnetic-field generating unit is provided for every reed member set.

11. The circuit protection device according to claim 9, wherein said contact gap reduction unit is provided for every reed member set.

12. A circuit protection device comprising:

at least one set of reed members having a pair of reed members, wherein each of the reed members is constituted by a magnetic material and disposed in such a way as to be opposed to the other of said reed members and has an end disposed in such a manner as to be apart by a predetermined gap from and contactable with an end of the other of said reed members;

a magnetic-field generating unit placed in a vicinity of the reed members set and adapted to generate a holding magnetic field for maintaining a state, in which the end of said reed members are in contact with each other, after the ends of said reed members are attracted to each other, and said ends are closed; and a contact gap reduction unit for reducing the gap to a gap corresponding to a pull-in of the magnetic field generated by said magnetic-field generating unit, wherein said reed member set further comprises a current shunting path, which an end connected to one reed member and also has another end adapted to be brought into contact with another reed member through a contact when said reed member set are in contact with each other, and to be released from said another reed member when said reed member set are released from each other.

13. The circuit protection device according to claim 12, wherein said current shunting path has a resistivity lower than that of a main conducting path formed by bringing the ends, which serve as contacts, of said reed member into contact with each other.

14. A circuit protection device comprising:

at least one set of reed members having a pair of reed members, wherein each of the reed members is constituted by a magnetic material and disposed in such a way as to be opposed to the other of said reed members and has an end disposed in such a manner as to be apart by a predetermined gap from and contactable with an end of the other of said reed members;

a magnetic-field generating unit placed in a vicinity of the reed members set and adapted to generate a holding magnetic field for maintaining a state, in which the end of said reed members are in contact with each other, after the ends of said reed members are attracted to each other, and said ends are closed; and a contact gap reduction unit for reducing the gap to a gap corresponding to a pull-in of the magnetic field generated by said magnetic-field generating unit, wherein magnetic poles of said magnetic-field generating unit are configured in such a manner as to be N-S-N or S-N-S in order.

15. A circuit protection device comprising:

at least one set of reed members having a pair of reed members, wherein each of the reed members is constituted by a magnetic material and disposed in such a way as to be opposed to the other of said reed members and has an end disposed in such a manner as to be apart by a predetermined gap from and contactable with an end of the other of said reed members;

a magnetic-field generating unit placed in a vicinity of the reed members set and adapted to generate a holding magnetic field for maintaining a state, in which the end of said reed members are in contact with each other, after the ends of said reed members are attracted to each other, and said ends are closed; and a contact gap reduction unit for reducing the gap to a gap corresponding to a pull-in of the magnetic field generated by said magnetic-field generating unit, wherein the reed members, arranged side by side, of at least two sets of the reed members arranged side by side are connected with each other via at least one insulated member.

16. A circuit protection device comprising:

at least one set of reed members having a pair of reed members, wherein each of the reed members is constituted by a magnetic material and disposed in such a way as to be opposed to the other of said reed members and has an end disposed in such a manner as to be apart by a predetermined gap from and contactable with an end of the other of said reed members;

a magnetic-field generating unit placed in a vicinity of the reed members set and adapted to generate a holding magnetic field for maintaining a state, in which the end of said reed members are in contact with each other, after the ends of said reed members are attracted to each other, and said ends are closed; and a contact gap reduction unit for reducing the gap to a gap corresponding to a pull-in of the magnetic field generated by said magnetic-field generating unit, which further comprises a surge arrester disposed in at least one end of said reed member set.

17. A device comprising:

a pair of reed members separated to form a gap;

a magnetic-field generating unit to generate a magnetic field, the magnetic field maintaining contact between the members; and a contact gap reduction unit to reduce the gap to a gap corresponding to a pull-in of the magnetic field, the contact gap reduction unit contacting one of the pair of reed members.

18. The device according to claim 17, wherein the contact gap reduction unit contacts one of the pair of members.

* * * * *